US009784144B2

(12) United States Patent
Haltiner, Jr. et al.

(10) Patent No.: US 9,784,144 B2
(45) **Date of Patent: *Oct. 10, 2017**

(54) CAMSHAFT PHASER WITH A ROTARY VALVE SPOOL

(71) Applicant: DELPHI TECHNOLOGIES, INC., Troy, MI (US)

(72) Inventors: Karl J. Haltiner, Jr., Fairport, NY (US); Thomas H. Fischer, Rochester, NY (US); Thomas H. Lichti, Victor, NY (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 62 days.

This patent is subject to a terminal disclaimer.

(21) Appl. No.: 14/803,491

(22) Filed: Jul. 20, 2015

(65) Prior Publication Data

US 2017/0022849 A1 Jan. 26, 2017

(51) Int. Cl.
*F01L 1/34* (2006.01)
*F01L 1/344* (2006.01)

(52) U.S. Cl.
CPC ... *F01L 1/3442* (2013.01); *F01L 2001/34423* (2013.01); *F01L 2001/34426* (2013.01); *F01L 2001/34433* (2013.01)

(58) Field of Classification Search
CPC ..... F01L 1/3442; F01L 2001/34423; F01L 2001/34426; F01L 2001/34433
USPC ..... 123/90.12, 90.15, 90.17
See application file for complete search history.

(56) References Cited

U.S. PATENT DOCUMENTS

| | | | | |
|---|---|---|---|---|
| 5,507,254 | A | 4/1996 | Melchior et al. | |
| 5,645,017 | A | 7/1997 | Melchior et al. | |
| 5,649,506 | A | 7/1997 | Melchior et al. | |
| 7,523,728 | B2 | 4/2009 | Berndorfer | |
| 8,534,246 | B2 | 9/2013 | Lichti et al. | |
| 9,127,575 | B2 * | 9/2015 | Fischer | F01L 1/3442 123/90.17 |
| 9,366,162 | B1 * | 6/2016 | Haltiner, Jr. | F01L 1/3442 123/90.17 |
| 2007/0017463 | A1 | 1/2007 | Mott et al. | |
| 2016/0146067 | A1 | 5/2016 | Haltiner, Jr. | |
| 2016/0222836 | A1 | 8/2016 | Haltiner, Jr. | |

FOREIGN PATENT DOCUMENTS

GB 2487227 A 7/2012

* cited by examiner

*Primary Examiner* — Ching Chang
(74) *Attorney, Agent, or Firm* — Joshua M. Haines

(57) ABSTRACT

A camshaft phaser includes a stator; a rotor defining an advance chamber and a retard chamber with the stator; a valve spool that is rotatable about an axis and defining a supply chamber and a vent chamber with the rotor; an actuator which rotates the valve spool to change the position of the rotor relative to the stator by 1) supplying oil from the supply chamber to the advance chamber and venting oil from the retard chamber to the vent chamber and 2) supplying oil from the supply chamber to the retard chamber and venting oil from the advance chamber to the vent chamber; and a check valve which is displaceable axially between an open position which allows oil to flow from the vent chamber to the supply chamber and a closed position which prevents oil from flowing from the supply chamber to the vent chamber.

32 Claims, 22 Drawing Sheets

CAMSHAFT PHASER WITH A ROTARY VALVE SPOOL

TECHNICAL FIELD OF INVENTION

The present invention relates to a camshaft phaser for varying the phase relationship between a crankshaft and a camshaft in an internal combustion engine; more particularly to such a camshaft phaser which is a vane-type camshaft phaser; even more particularly to a vane-type camshaft phaser which includes a control valve in which the position of the control valve determines the phase relationship between the crankshaft and the camshaft; and still even more particularly to such a camshaft phaser which uses torque reversals of the camshaft to actuate the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance chambers and retard chambers by a phasing oil control valve in order to rotate the rotor within the stator and thereby change the phase relationship between the camshaft and the crankshaft. One such camshaft phaser is described in U.S. Pat. No. 8,534,246 to Lichti et al., the disclosure of which is incorporated herein by reference in its entirety and hereinafter referred to as Lichti et al. As is typical for phasing oil control valves, the phasing oil control valve of Lichti et al. operates on the principle of direction control, i.e. the position of the oil control valve determines the direction of rotation of the rotor relative to the stator. More specifically, when a desired phase relationship between the camshaft and the crankshaft is determined, the desired phase relationship is compared to the actual phase relationship as determined from the outputs of a camshaft position sensor and a crankshaft position sensor. If the actual phase relationship, does not match the desired phase relationship, the oil control valve is actuated to either 1) an advance position to supply oil to the retard chambers and vent oil from the advance chambers or 2) a retard position to supply oil to the advance chambers and vent oil from the retard chambers until the actual phase relationship matches the desired phase relationship. When the actual phase relationship matches the desired phase relationship, the oil control valve is positioned to hydraulically lock the rotor relative to the stator. However, leakage from the advance chambers and the retard chambers or leakage from the oil control valve may cause the phase relationship to drift over time. When the drift in phase relationship is detected by comparing the actual phase relationship to the desired phase relationship, the oil control valve must again be actuated to either the advance position or the retard position in order to correct for the drift, then the oil control valve is again positioned to hydraulically lock the rotor relative to the stator after the correction has been made. Consequently, the position of the rotor relative to the stator is not self-correcting and relies upon actuation of the phasing oil control valve to correct for the drift.

U.S. Pat. No. 5,507,254 to Melchior, hereinafter referred to as Melchior, teaches a camshaft phaser with a phasing oil control valve which allows for self-correction of the rotor relative to the stator as may be necessary due to leakage from the advance chamber or from the retard chamber. Melchior also teaches that the valve spool defines a first recess and a second recess separated by a rib such that one of the recesses acts to supply oil to the advance chamber when a retard in timing of the camshaft is desired while the other recess acts to supply oil to the retard chamber when an advance in the timing of the camshaft is desired. The recess that does not act to supply oil when a change in phase is desired does not act as a flow path. However, improvements are always sought in any art.

What is needed is a camshaft phaser which minimizes or eliminates one or more the shortcomings as set forth above.

SUMMARY OF THE INVENTION

Briefly described, a camshaft phaser is provided for controllably varying the phase relationship between a crankshaft and a camshaft in an internal combustion engine. The camshaft phaser includes an input member connectable to the crankshaft of the internal combustion engine to provide a fixed ratio of rotation between the input member and the crankshaft; an output member connectable to the camshaft of the internal combustion engine and defining an advance chamber and a retard chamber with the input member; a valve spool coaxially disposed within the output member such that the valve spool is rotatable about an axis relative to the output member and the input member, the valve spool defining a supply chamber and a vent chamber with the output member; an actuator which rotates the valve spool in order to change the position of the output member relative to the input member by 1) supplying oil from the supply chamber to the advance chamber and venting oil from the retard chamber to the vent chamber when retarding the phase relationship of the camshaft relative to the crankshaft is desired and 2) supplying oil from the supply chamber to the retard chamber and venting oil from the advance chamber to the vent chamber when advancing the phase relationship between the camshaft relative to the crankshaft is desired; and a phasing check valve which is displaceable axially between 1) an open position which allows oil to flow from the vent chamber to the supply chamber and 2) a closed position which prevents oil from flowing from the supply chamber to the vent chamber.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
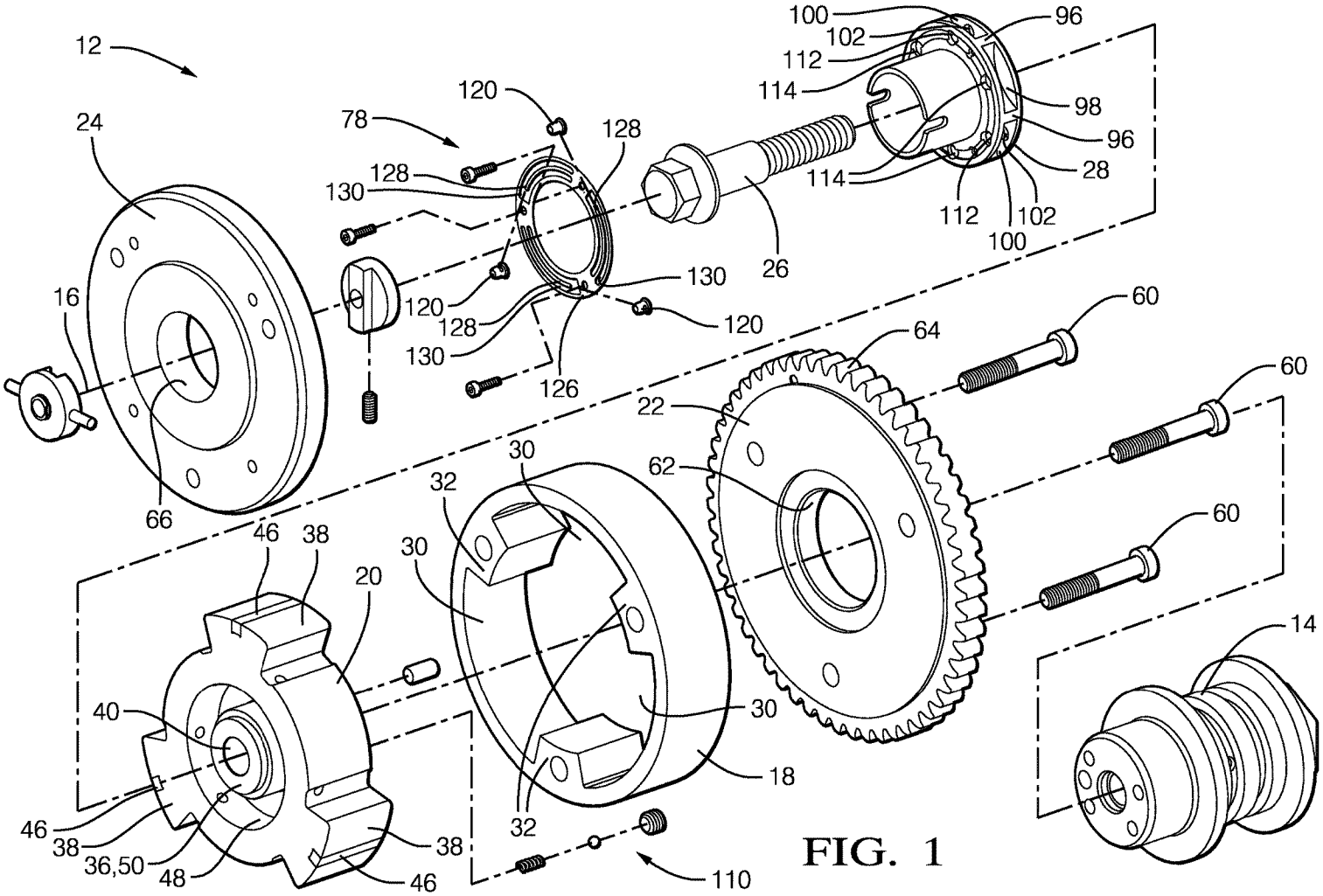
FIG. 1 is an exploded isometric view of a camshaft phaser in accordance with the present invention.
Figure 2:
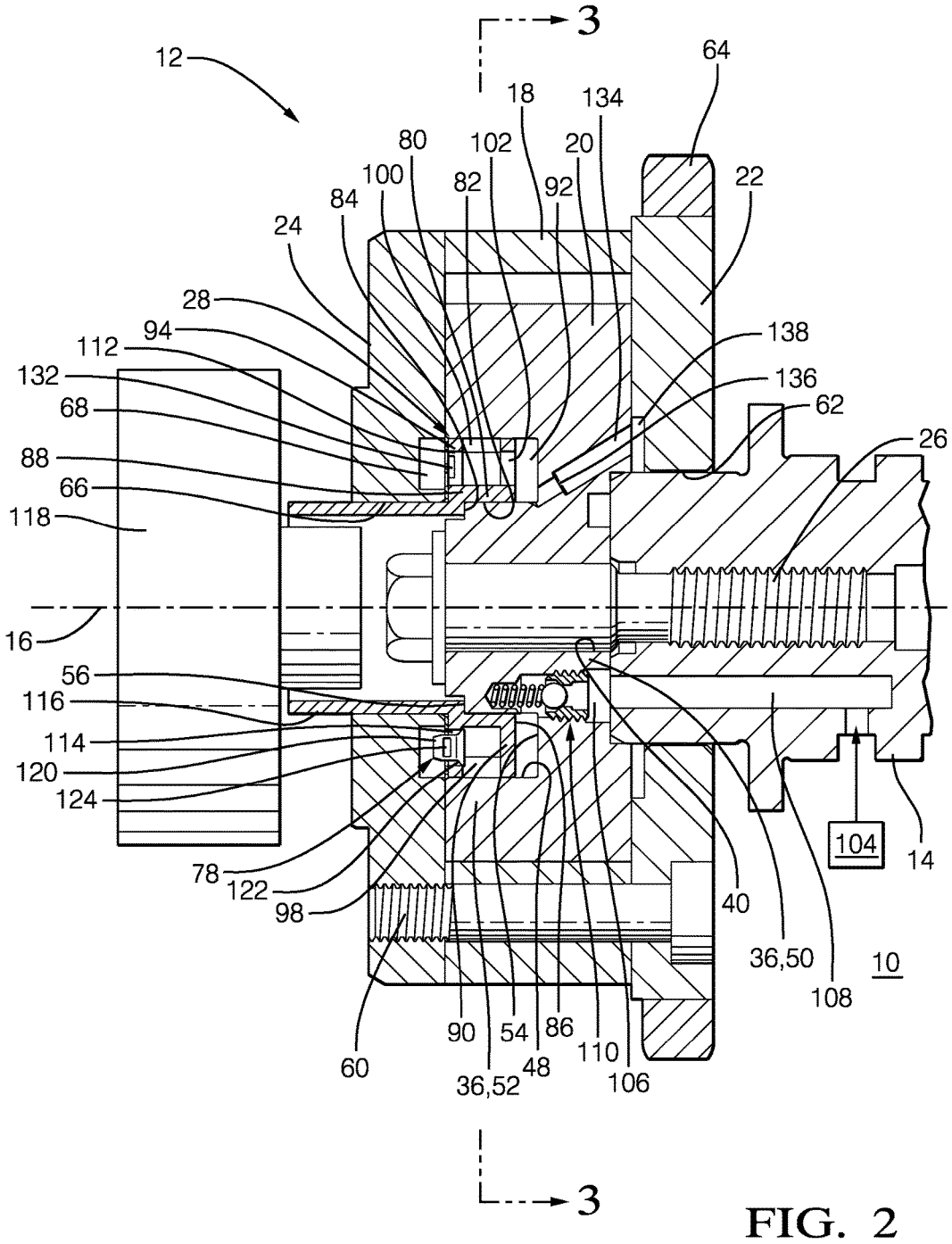
FIG. 2 is an axial cross-section view of the camshaft phaser of FIG. 1.
Figure 3:
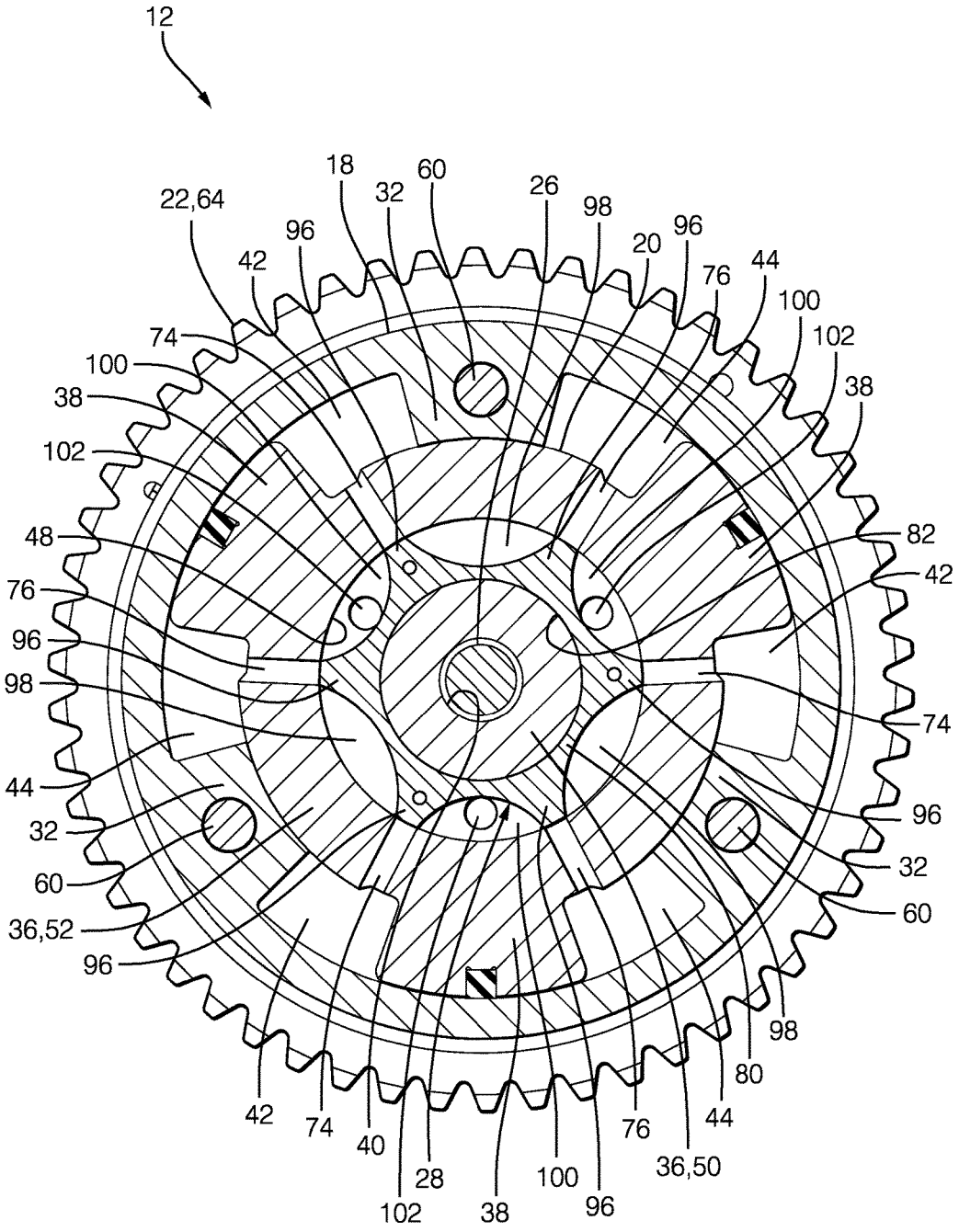
FIG. 3 is a radial cross-sectional view of the camshaft phaser taken through section line 3-3 of FIG. 2 and showing a valve spool of the camshaft phaser in a hold position which maintains a rotational position of a rotor of the camshaft phaser relative to a stator of the camshaft phaser.

In accordance with a preferred embodiment of this invention and referring to FIGS. 1-3, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing or phase between the crankshaft and camshaft 14 to be varied. In this way, opening and closing of the intake and/or exhaust valves can be advanced or retarded in order to achieve desired engine performance.

Camshaft phaser 12 generally includes a stator 18 which acts as an input member, a rotor 20 disposed coaxially within stator 18 which acts as an output member, a back cover 22 closing off one axial end of stator 18, a front cover 24 closing off the other axial end of stator 18, a camshaft phaser attachment bolt 26 for attaching camshaft phaser 12 to camshaft 14, and a valve spool 28. The rotational position of valve spool 28 relative to stator 18 determines the rotational position of rotor 20 relative to stator 18, unlike typical valve spools which move axially to determine only the direction the rotor will rotate relative to the stator. The various elements of camshaft phaser 12 will be described in greater detail in the paragraphs that follow.

Stator 18 is generally cylindrical and includes a plurality of radial chambers 30 defined by a plurality of lobes 32 extending radially inward. In the embodiment shown, there are three lobes 32 defining three radial chambers 30, however, it is to be understood that a different number of lobes 32 may be provided to define radial chambers 30 equal in quantity to the number of lobes 32.

Rotor 20 includes a rotor central hub 36 with a plurality of vanes 38 extending radially outward therefrom and a rotor central through bore 40 extending axially therethrough. The number of vanes 38 is equal to the number of radial chambers 30 provided in stator 18. Rotor 20 is coaxially disposed within stator 18 such that each vane 38 divides each radial chamber 30 into advance chambers 42 and retard chambers 44. The radial tips of lobes 32 are mateable with rotor central hub 36 in order to separate radial chambers 30 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Rotor central hub 36 defines an annular valve spool recess 48 which extends part way into rotor central hub 36 from the axial end of rotor central hub 36 that is proximal to front cover 24. As a result, rotor central hub 36 includes a rotor central hub inner portion 50 that is annular in shape and bounded radially inward by rotor central through bore 40 and bounded radially outward by annular valve spool recess 48. Also as a result, rotor central hub 36 includes a rotor central hub outer portion 52 that is bounded radially inward by annular valve spool recess 48 and is bounded radially outward by the radially outward portion of rotor central hub outer portion 52 from which lobes 32 extend radially outward. Since annular valve spool recess 48 extends only part way into rotor central hub 36, annular valve spool recess 48 defines an annular valve spool recess bottom 54 which is annular in shape and extends between rotor central hub inner portion 50 and rotor central hub outer portion 52. As shown, the outer circumference of rotor central hub inner portion 50 may be stepped, thereby defining a valve spool recess shoulder 56 that is substantially perpendicular to camshaft axis 16 and faces toward front cover 24.

Back cover 22 is sealingly secured, using cover bolts 60, to the axial end of stator 18 that is proximal to camshaft 14. Tightening of cover bolts 60 prevents relative rotation between back cover 22 and stator 18. Back cover 22 includes a back cover central bore 62 extending coaxially therethrough. The end of camshaft 14 is received coaxially within back cover central bore 62 such that camshaft 14 is allowed to rotate relative to back cover 22. Back cover 22 may also include a sprocket 64 formed integrally therewith or otherwise fixed thereto. Sprocket 64 is configured to be driven by a chain that is driven by the crankshaft of internal combustion engine 10. Alternatively, sprocket 64 may be a pulley driven by a belt or any other known drive member known for driving camshaft phaser 12 by the crankshaft. In an alternative arrangement, sprocket 64 may be integrally formed or otherwise attached to stator 18 rather than back cover 22.

Similarly, front cover 24 is sealingly secured, using cover bolts 60, to the axial end of stator 18 that is opposite back cover 22. Cover bolts 60 pass through back cover 22 and stator 18 and threadably engage front cover 24; thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24. Front cover 24 includes a front cover central bore 66 extending coaxially therethrough and a recirculation chamber 68 which is annular in shape and extending coaxially thereinto from the side of front cover 24 which is adjacent to stator 18.

Camshaft phaser 12 is attached to camshaft 14 with camshaft phaser attachment bolt 26 which extends coaxially through rotor central through bore 40 of rotor 20 and threadably engages camshaft 14, thereby clamping rotor 20 securely to camshaft 14. More specifically, rotor central hub inner portion 50 is clamped between the head of camshaft phaser attachment bolt 26 and camshaft 14. In this way, relative rotation between stator 18 and rotor 20 results in a change in phase or timing between the crankshaft of internal combustion engine 10 and camshaft 14.

Oil is selectively transferred to advance chambers 42 from retard chambers 44, as result of torque applied to camshaft 14 from the valve train of internal combustion engine 10, i.e. torque reversals of camshaft 14, in order to cause relative rotation between stator 18 and rotor 20 which results in retarding the timing of camshaft 14 relative to the crankshaft of internal combustion engine 10. Conversely, oil is selectively transferred to retard chambers 44 from advance chambers 42, as result of torque applied to camshaft 14 from the valve train of internal combustion engine 10, in order to cause relative rotation between stator 18 and rotor 20 which results in advancing the timing of camshaft 14 relative to the crankshaft of internal combustion engine 10. Rotor advance passages 74 may be provided in rotor 20 for supplying and venting oil to and from advance chambers 42 while rotor retard passages 76 may be provided in rotor 20 for supplying and venting oil to and from retard chambers 44. Rotor advance passages 74 extend radially outward through rotor central hub outer portion 52 from annular valve spool recess 48 to advance chambers 42 while rotor retard passages 76 extend radially outward through rotor central hub outer portion 52 from annular valve spool recess 48 to retard chambers 44. Transferring oil to advance chambers 42 from retard chambers 44 and transferring oil to retard chambers 44 from advance chambers 42 is controlled by valve spool 28 and recirculation check valves 78, as will be described in detail later, such that valve spool 28 is disposed coaxially and rotatably within annular valve spool recess 48.

Rotor 20 and valve spool 28, which act together to function as a valve, will now be described in greater detail with continued reference to FIGS. 1-3. Valve spool 28 includes a spool central hub 80 with a spool central through bore 82 extending coaxially therethrough. Spool central through bore 82 is stepped, thereby defining a valve spool shoulder 84 which is substantially perpendicular to camshaft axis 16 and which faces toward rotor 20. Valve spool 28 is received coaxially within annular valve spool recess 48 such that valve spool shoulder 84 abuts valve spool recess shoulder 56 and such that valve spool 28 radially surrounds camshaft phaser attachment bolt 26. Spool central through bore 82 is sized to mate with rotor central hub inner portion 50 in a close sliding interface such that valve spool 28 is able to freely rotate on rotor central hub inner portion 50 while substantially preventing oil from passing between the interface of spool central through bore 82 and rotor central hub inner portion 50 and also substantially preventing radial movement of valve spool 28 within annular valve spool recess 48. Spool central hub 80 extends axially from a spool hub first end 86 which is proximal to valve spool recess bottom 54 to a spool hub second end 88 which is distal from valve spool recess bottom 54. Valve spool 28 also includes an annular spool base 90 which extends radially outward from spool central hub 80 at spool hub first end 86 such that annular spool base 90 is axially offset from valve spool recess bottom 54, thereby defining an annular oil make-up chamber 92 axially between valve spool recess bottom 54 and annular spool base 90. Valve spool 28 also includes an annular spool top 94 which extends radially outward from spool central hub 80 such that annular spool top 94 axially abuts front cover 24 and such that annular spool top 94 is axially spaced from annular spool base 90. Consequently, annular spool base 90 and annular spool top 94 are captured axially between valve spool recess bottom 54 and front cover 24 such that axial movement of valve spool 28 relative to rotor 20 is substantially prevented. A plurality of valve spool lands 96 extend radially outward from spool central hub 80 in a polar array such that valve spool lands 96 join annular spool base 90 and annular spool top 94, thereby defining a plurality of alternating supply chambers 98 and vent chambers 100 between annular spool base 90 and annular spool top 94. The number of valve spool lands 96 is equal to the sum of the number of advance chambers 42 and the number of retard chambers 44, and as shown in the figures of the described embodiment, there are six valve spool lands 96.

Annular spool base 90 includes oil make-up passages 102 extending axially therethrough which provide fluid communication between respective vent chambers 100 and oil make-up chamber 92. Oil make-up chamber 92 receives pressurized oil from an oil source 104, for example, an oil pump of internal combustion engine 10, via a rotor supply passage 106 formed in rotor 20 and also via a camshaft supply passage 108 formed in camshaft 14. An oil make-up check valve 110 is located within rotor supply passage 106 in order to prevent oil from back-flowing from oil make-up chamber 92 to oil source 104 while allowing oil to be supplied to oil make-up chamber 92 from oil source 104.

Annular spool top 94 includes spool vent passages 112 extending axially therethrough which provide fluid communication between respective vent chambers 100 and recirculation chamber 68. It should be noted that oil make-up chamber 92 and recirculation chamber 68 are in constant fluid communication with each other via oil make-up passages 102, vent chambers 100, and spool vent passages 112, and consequently, recirculation chamber 68 and oil make-up chamber 92 are maintained at a common pressure. It should also be noted that the surface area of the face of annular spool base 90 that defines in part oil make-up chamber 92 is substantially the same as the surface area of the face of annular spool top 94 that faces toward recirculation chamber 68, thereby causing equal and opposite hydraulic loads in oil make-up chamber 92 and recirculation chamber 68, and also thereby preventing an unbalanced axial load on valve spool 28. Annular spool top 94 also includes spool supply passages 114 extending axially therethrough which provide fluid communication between respective supply chambers 98 and recirculation chamber 68. Recirculation check valves 78 are configured to allow oil to flow from recirculation chamber 68 to respective supply chambers 98 through respective spool supply passages 114. Recirculation check valves 78 are also configured to prevent oil to flow from respective supply chambers 98 to recirculation chamber 68 through respective spool supply passages 114.

Valve spool 28 also includes a valve spool drive extension 116 which extends axially from annular spool top 94 and through front cover central bore 66. Valve spool drive extension 116 and front cover central bore 66 are sized to interface in a close sliding fit which permits valve spool 28 to rotate freely relative to front cover 24 while substantially preventing oil from passing between the interface of valve spool drive extension 116 and front cover central bore 66. Valve spool drive extension 116 is arranged to engage an actuator 118 which is used to rotate valve spool 28 relative to stator 18 and rotor 20 as required to achieve a desired rotational position of rotor 20 relative to stator 18 as will be described in greater detail later. Actuator 118 may be, by way of non-limiting example only, an electric motor which is stationary relative to internal combustion engine 10 and connected to valve spool drive extension 116 through a gear set or an electric motor which rotates with camshaft phaser 12 and which is powered through slip rings. One such actuator and gear set is show in U.S. patent application Ser. No. 14/613,630 to Haltiner filed on Feb. 4, 2015, the disclosure of which is incorporated herein by reference in its entirety. Actuator 118 may be controlled by an electronic controller (not shown) based on inputs from various sensors (not shown) which may provide signals indicative of, by way of non-limiting example only, engine temperature, ambient temperature, intake air flow, manifold pressure, exhaust constituent composition, engine torque, engine speed, throttle position, crankshaft position, and camshaft position. Based on the inputs from the various sensors, the electronic controller may determine a desired phase relationship between the crankshaft and camshaft 14, thereby commanding actuator 118 to rotate valve spool 28 relative to stator 18 and rotor 20 as required to achieve the desired rotational position of rotor 20 relative to stator 18.

Each recirculation check valve 78 includes a recirculation check valve body 120 defining a tapered recirculation check valve seating surface 122 which selectively seats with annular spool top 94 to block a respective spool supply passage 114 and which selectively unseats from annular spool top 94 to open a respective spool supply passage 114 such that each recirculation check valve 78 opens inward into a respective spool supply passage 114. Each recirculation check valve body 120 extends through a respective spool supply passage 114 and includes a retention aperture 124 extending therethrough in a direction substantially perpendicular to camshaft axis 16. Each recirculation check valve body 120 is retained and biased toward engagement with a recirculation check valve plate 126 which is annular in shape and which is fixed to the face of annular spool top 94 which faces toward front cover 24. Recirculation check valve plate 126 defines respective recirculation check valve arms 128 associated with a respective recirculation check valve body 120. Each recirculation check valve arm 128 is defined by a recirculation check valve plate slot 130 such that each recirculation check valve arm 128 is arcuate in shape and extends through a respective retention aperture 124. Recirculation check valve arms 128 are resilient and compliant such that recirculation check valve arms 128 bias recirculation check valve bodies 120 toward seating with annular spool top 94. In order to accommodate flexure of recirculation check valve arms 128 which allows recirculation check valve bodies 120 to unseat from annular valve spool top 94, annular valve spool top 94 is provided with valve spool top recess 132 which is annular in shape and extends axially into the face of annular valve spool top 94 which faces toward front cover 24. In this way, recirculation check valves 78 are displaceable axially between an open position which allows oil to flow from vent chambers 100 to supply chambers 98 and a closed position which prevents oil from flowing from supply chambers 98 to vent chambers 100. It should be noted that recirculation check valves 78 open into respective supply chambers 98.

Rotor 20 may include an air purge passage 134 in order to purge air from oil that is supplied to oil make-up chamber 92. Air purge passage 134 extends through rotor 20 from oil make-up chamber 92 to the face of rotor 20 that faces toward back cover 22. A restriction orifice 136 is located within air purge passage 134 and is sized to minimize the volume of oil that can flow therethrough in order to prevent air purge passage 134 from significantly detracting from the flow of oil from vent chambers 100 to supply chambers 98 while still permitting air to be purged. Back cover 22 includes a back cover annular recess 138 which faces toward rotor 20 and extends radially inward from back cover central bore 62 such that back cover annular recess 138 is in fluid communication with air purge passage 134. Air that is communicated to back cover annular recess 138 is allowed to escape between the radial clearance between camshaft 14 and back cover central bore 62.

Operation of camshaft phaser 12 will now be described with continued reference to FIGS. 1-3 and now with additional reference to FIGS. 4A-5D. The rotational position of rotor 20 relative to stator 18 is determined by the rotational position of valve spool 28 relative to stator 18. When the rotational position of rotor 20 relative to stator 18 is at a desired position to achieve desired operational performance of internal combustion engine 10, the rotational position of valve spool 28 relative to stator 18 is maintained constant by actuator 118. Consequently, a hold position as shown in FIG. 3 is defined when each valve spool land 96 is aligned with a respective rotor advance passage 74 or a respective rotor retard passage 76, thereby preventing fluid communication into and out of advance chambers 42 and retard chambers 44 and hydraulically locking the rotational position of rotor 20 relative to stator 18. In this way, the phase relationship between camshaft 14 and the crankshaft is maintained.

Figure 4A:
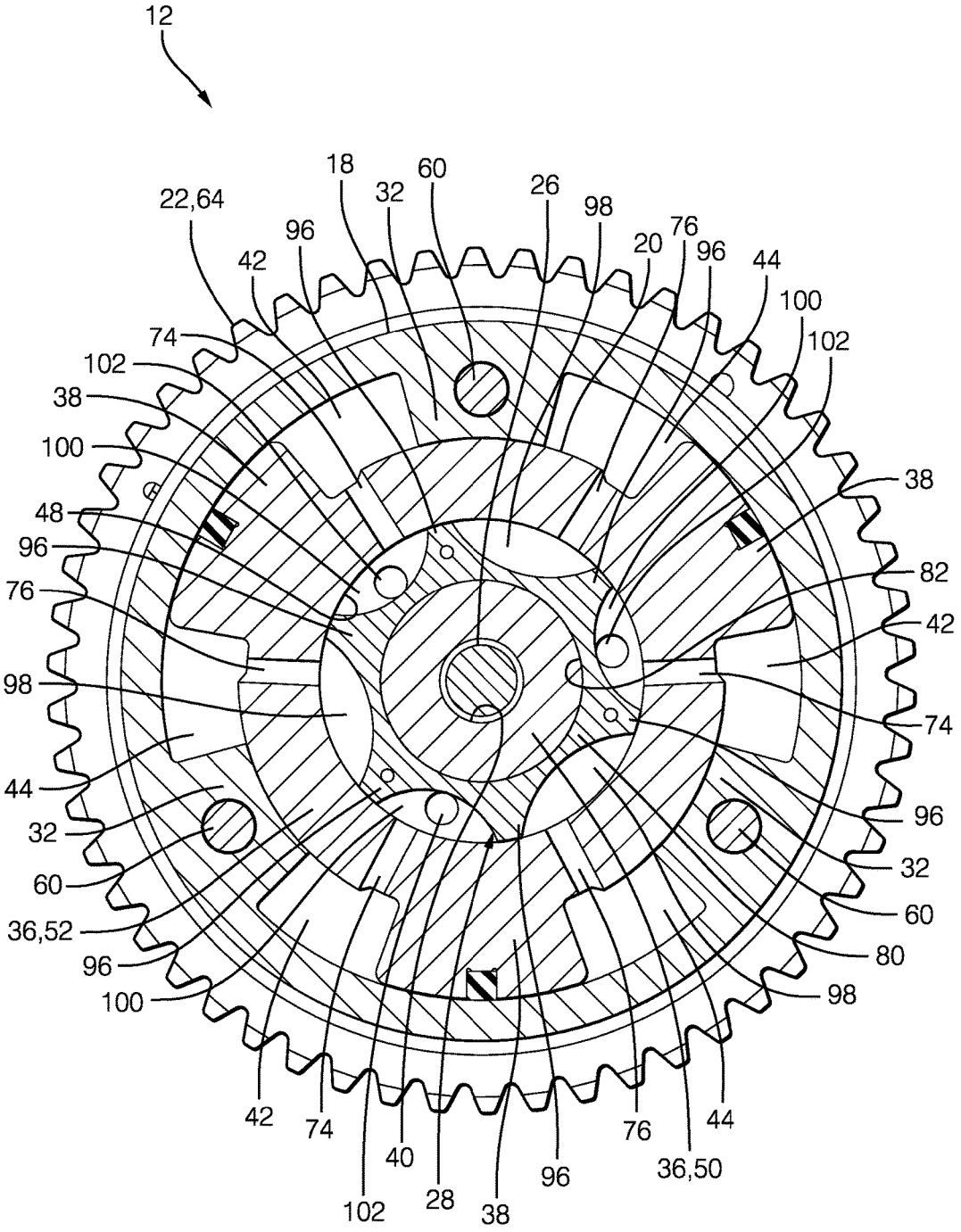
FIG. 4A is a radial cross-sectional view of the camshaft phaser taken through section line 3-3 of FIG. 2 showing the valve spool in a position which will result in a clockwise rotation of the rotor relative to the stator.
Figure 4B:
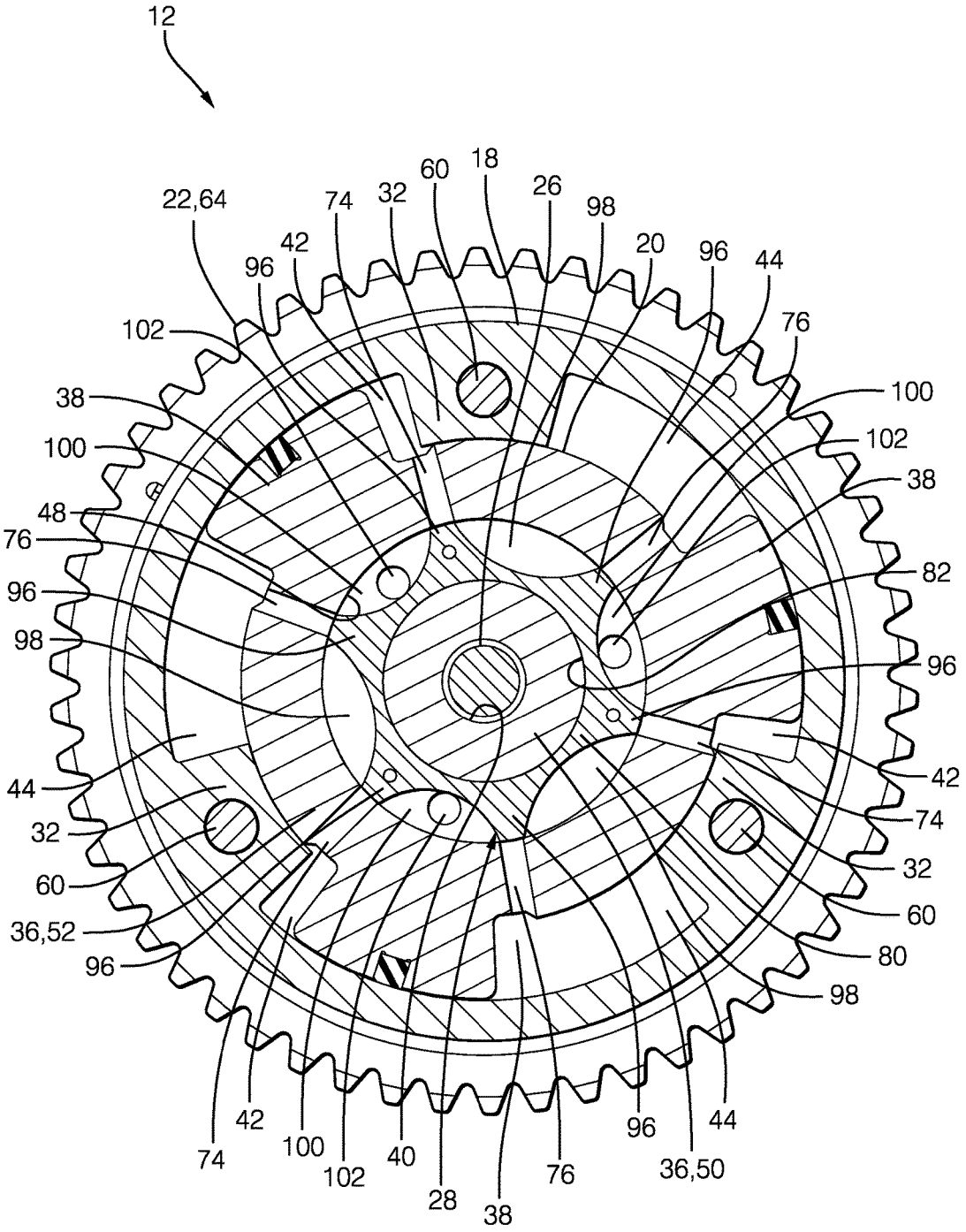
FIG. 4B is a radial cross-sectional view of the camshaft phaser taken through section line 3-3 of FIG. 2 showing the rotor after being rotated clockwise as a result of the position of the valve spool as shown in FIG. 4A.
Figure 4C:
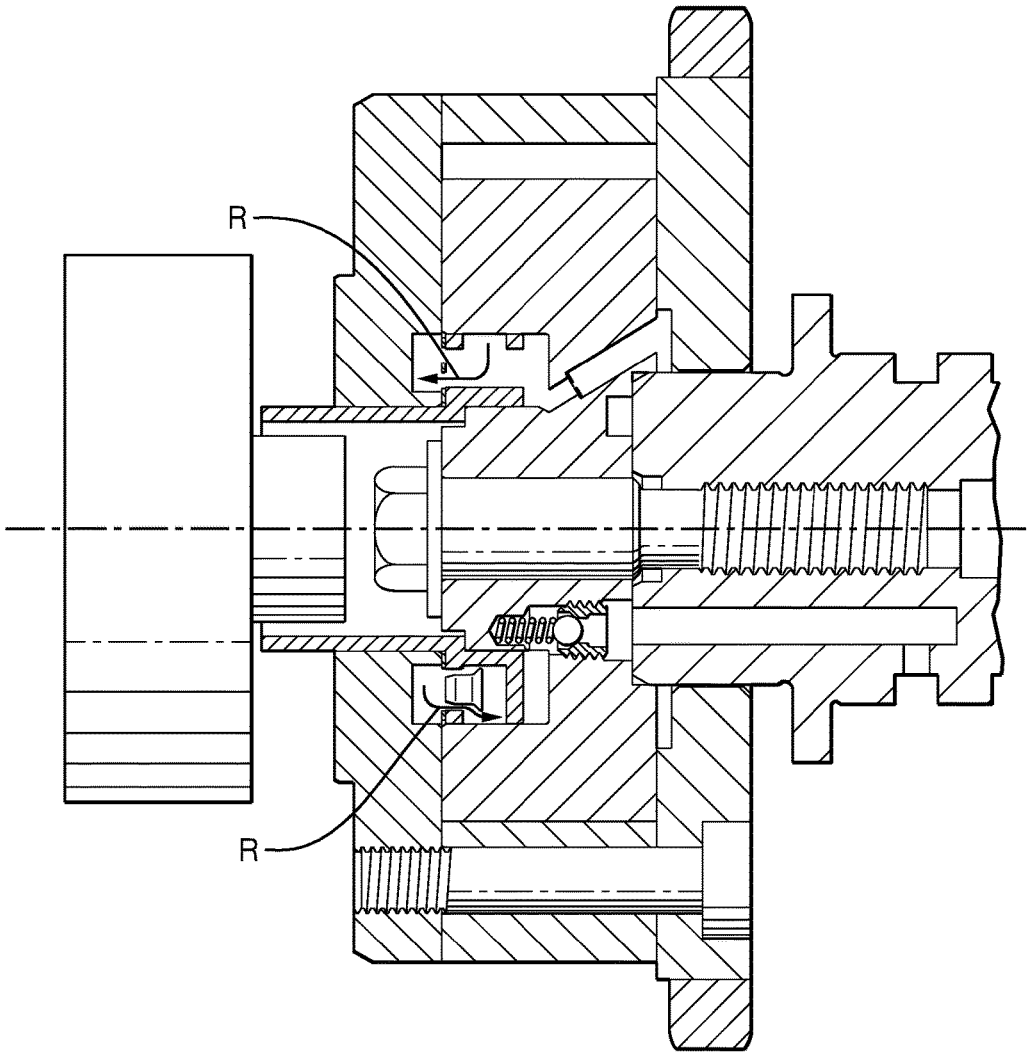
FIG. 4C is the axial cross-sectional view of FIG. 2 with reference numbers removed in order to clearly shown the path of oil flow as a result of the position of the valve spool as shown in FIG. 4A.
Figure 4D:
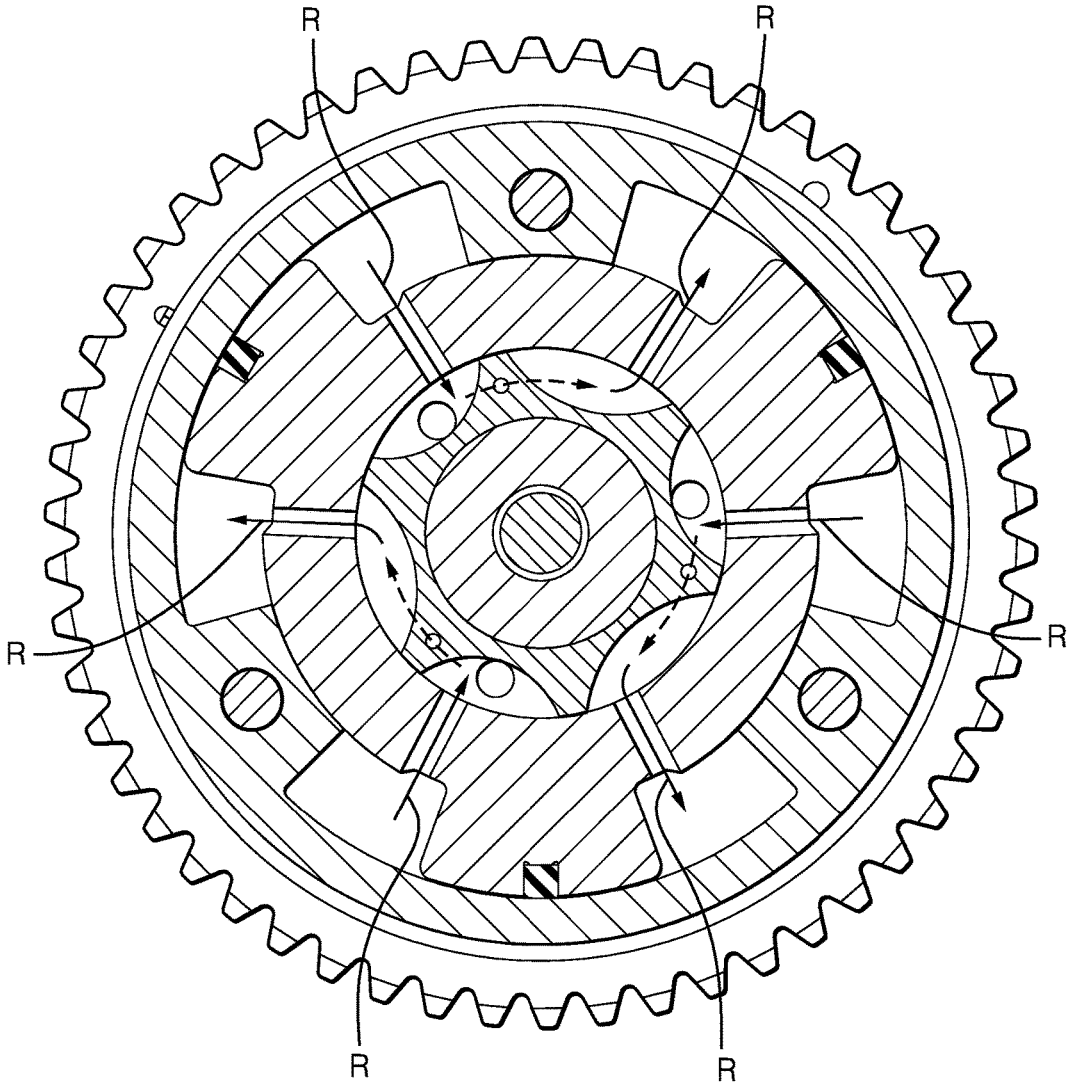
FIG. 4D is the radial cross-sectional view of FIG. 4A with reference numbers removed in order to clearly shown the path of oil flow as a result of the position of the valve spool as shown in FIG. 4A.

As shown in FIGS. 4A-4F, if a determination is made to advance the phase relationship between camshaft 14 and the crankshaft, it is necessary to rotate rotor 20 clockwise relative to stator 18 as viewed in the figures and as embodied by camshaft phaser 12. In order to rotate rotor 20 to the desired rotational position relative to stator 18, actuator 118 causes valve spool 28 to rotate clockwise relative to stator 18 to a rotational position of valve spool 28 relative to stator 18 that will also determine the rotational position of rotor 20 relative to stator 18. When valve spool 28 is rotated clockwise relative to stator 18, valve spool lands 96 are moved out of alignment with rotor advance passages 74 and rotor retard passages 76, thereby providing fluid communication between supply chambers 98 and retard chambers 44 and also between vent chambers 100 and advance chambers 42. Consequently, torque reversals of camshaft 14 which tend to pressurize oil within advance chambers 42 cause oil to be communicated from advance chambers 42 to retard chambers 44 via rotor advance passages 74, vent chambers 100, spool vent passages 112, recirculation chamber 68, spool supply passages 114, supply chambers 98, and rotor retard passages 76. However, torque reversals of camshaft 14 which tend to pressurize oil within retard chambers 44 and apply a counterclockwise torque to rotor 20 are prevented from venting oil from retard chambers 44 because recirculation check valves 78 prevent oil from flowing out of supply chambers 98 and being supplied to advance chambers 42. It should be noted that torque reversals of camshaft 14 which apply a counterclockwise torque to rotor 20 results in high pressure being generated within supply chambers 98; however, the high pressure is contained within supply chambers 98 by recirculation check valves 78, thereby preventing axial loading from being applied to front cover 24 and back cover 22. Recirculation check valves 78 also isolate the high pressure within supply chambers 98 from the supply pressure of oil source 104. Oil continues to be supplied to retard chambers 44 from advance chambers 42 until rotor 20 is rotationally displaced sufficiently far for each valve spool land 96 to again align with respective rotor advance passages 74 and rotor retard passages 76 as shown in FIG. 4B, thereby again preventing fluid communication into and out of advance chambers 42 and retard chambers 44 and hydraulically locking the rotational position of rotor 20 relative to stator 18. In FIGS. 4C and 4D, which are the same cross-sectional views of FIGS. 2, and 4A respectively, the reference numbers have been removed for clarity, and arrows R have been included to represent oil that is being recirculated for rotating rotor 20 relative to stator 18. It should be noted that FIG. 4C shows recirculation check valve 78 being opened, but recirculation check valves 78 may also be closed depending on the direction of the torque reversal of camshaft 14 at a particular time.

Figure 5A:
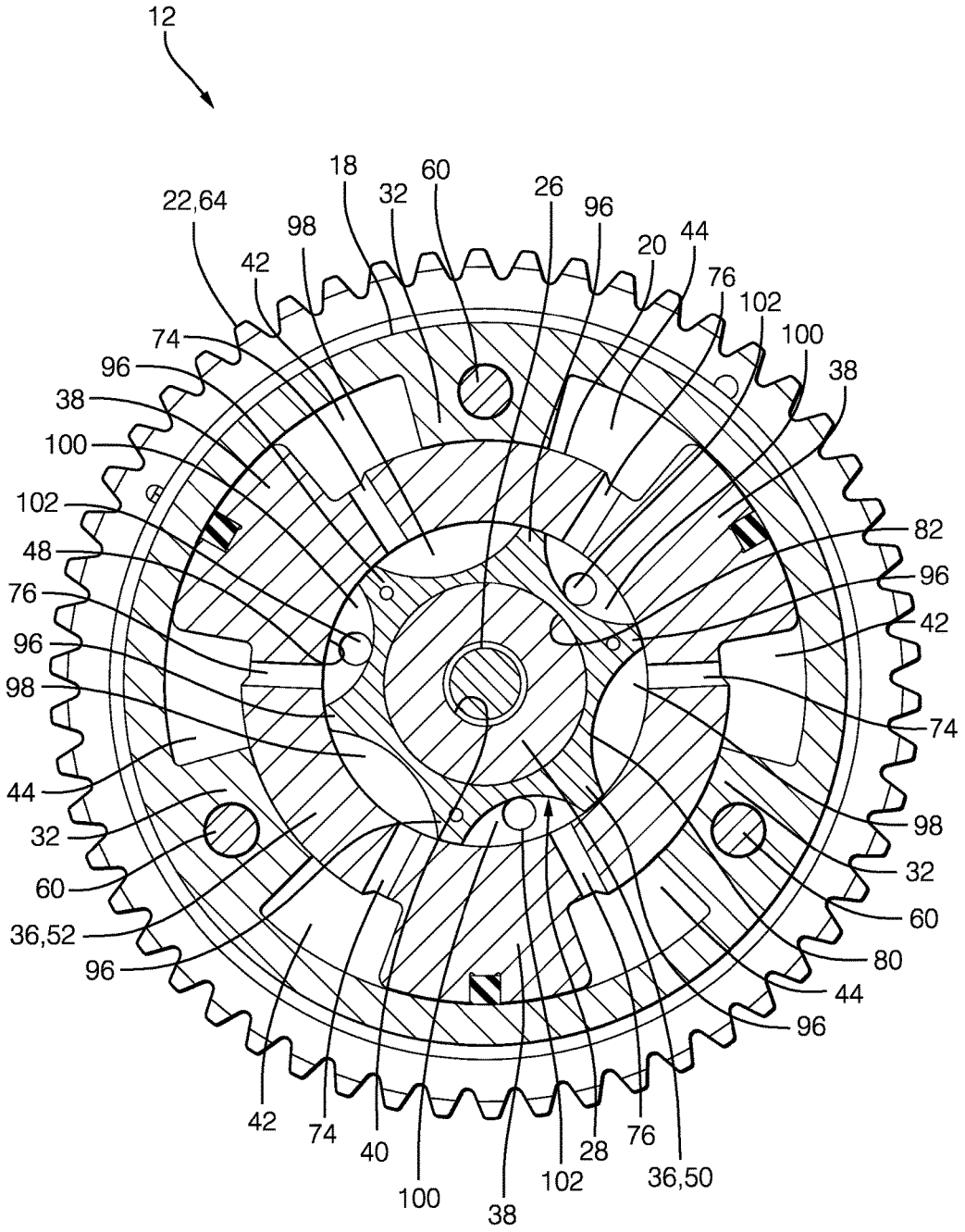
FIG. 5A is a radial cross-sectional view of the camshaft phaser taken through section line 3-3 of FIG. 2 showing the valve spool in a position which will result in a counterclockwise rotation of the rotor relative to the stator.
Figure 5B:
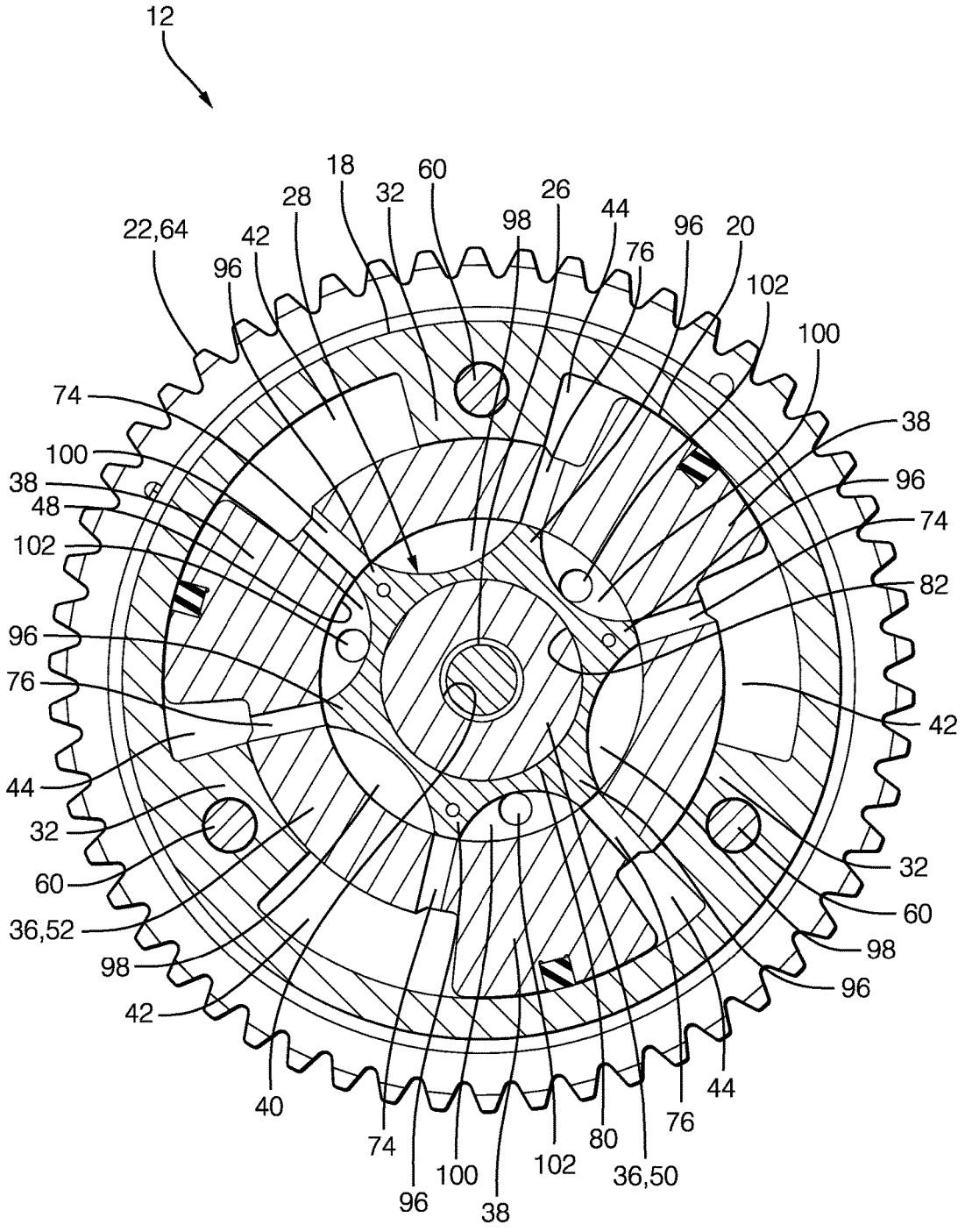
FIG. 5B is a radial cross-sectional view of the camshaft phaser taken through section line 3-3 of FIG. 2 showing the rotor after being rotated counterclockwise as a result of the position of the valve spool as shown in FIG. 5A.
Figure 5C:
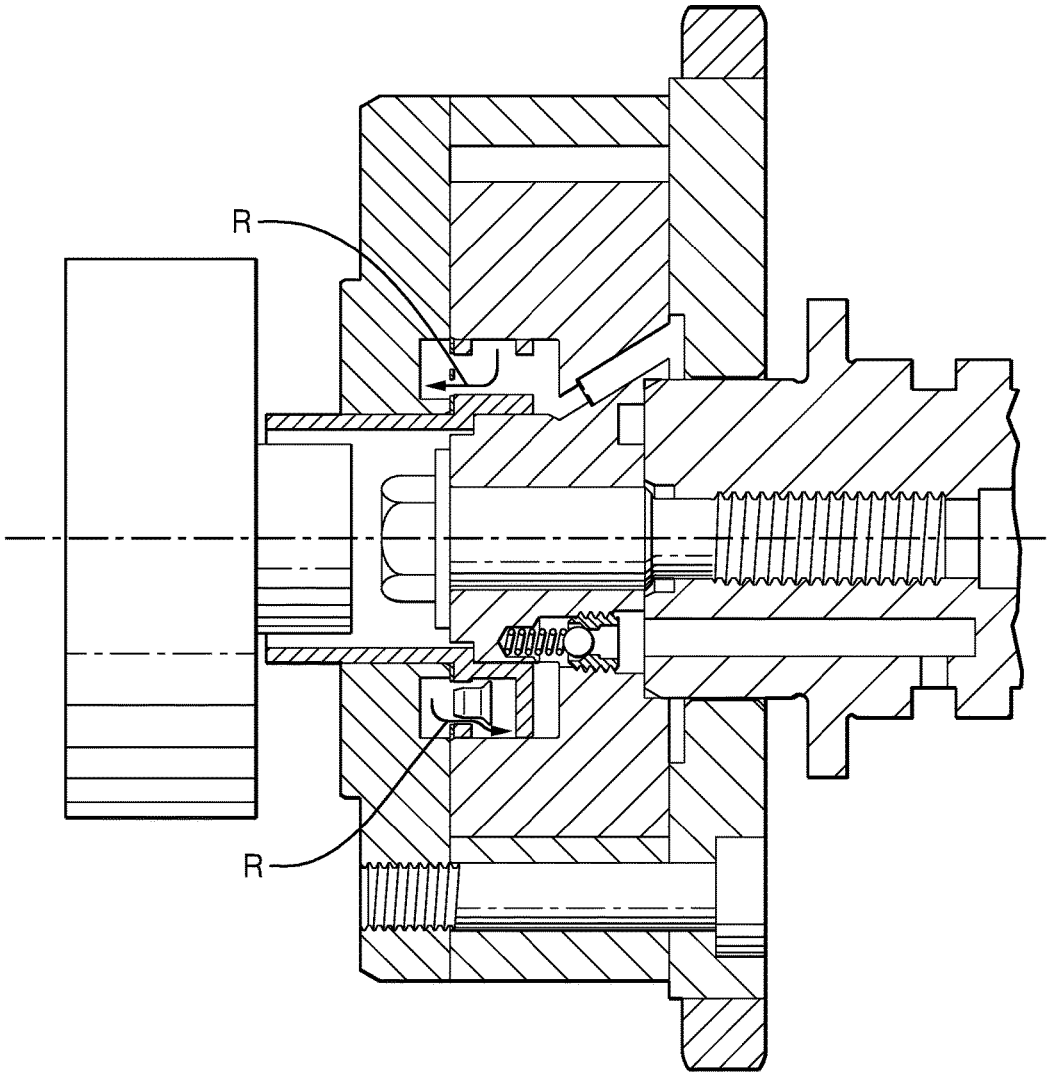
FIG. 5C is the axial cross-sectional view of FIG. 2 with reference numbers removed in order to clearly shown the path of oil flow as a result of the position of the valve spool as shown in FIG. 5A.
Figure 5D:
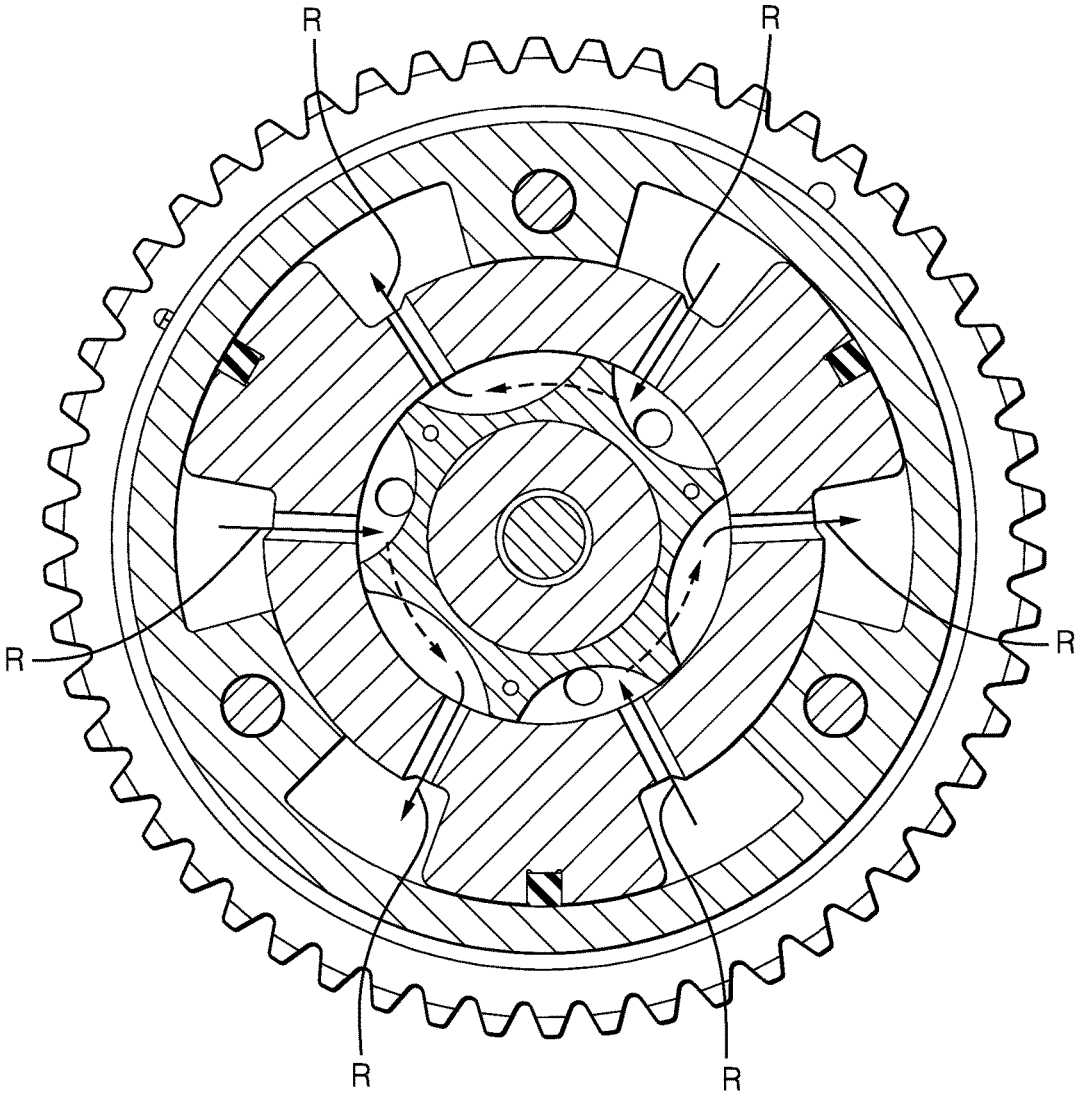
FIG. 5D is the radial cross-sectional view of FIG. 5A with reference numbers removed in order to clearly shown the path of oil flow as a result of the position of the valve spool as shown in FIG. 5A.

Conversely, as shown in FIGS. 5A-5D, if a determination is made to retard the phase relationship between camshaft 14 and the crankshaft, it is necessary to rotate rotor 20 counterclockwise relative to stator 18 as viewed in the figures and as embodied by camshaft phaser 12. In order to rotate rotor 20 to the desired rotational position relative to stator 18, actuator 118 causes valve spool 28 to rotate counterclockwise relative to stator 18 to a rotational position of valve spool 28 relative to stator 18 that will also determine the rotational position of rotor 20 relative to stator 18. When valve spool 28 is rotated counterclockwise relative to stator 18, valve spool lands 96 are moved out of alignment with rotor advance passages 74 and rotor retard passages 76, thereby providing fluid communication between supply chambers 98 and advance chambers 42 and also between vent chambers 100 and retard chambers 44. Consequently, torque reversals of camshaft 14 which tend to pressurize oil within retard chambers 44 cause oil to be communicated from retard chambers 44 to advance chambers 42 via rotor retard passages 76, vent chambers 100, spool vent passages 112, recirculation chamber 68, spool supply passages 114, supply chambers 98, and rotor advance passages 74. However, torque reversals of camshaft 14 which tend to pressurize oil within advance chambers 42 and apply a clockwise torque to rotor 20 are prevented from venting oil from advance chambers 42 because recirculation check valves 78 prevent oil from flowing out of supply chambers 98 and being supplied to retard chambers 44. It should be noted that torque reversals of camshaft 14 which apply a clockwise torque to rotor 20 results in high pressure being generated within supply chambers 98; however, the high pressure is contained within supply chambers 98 by recirculation check valves 78, thereby preventing axial loading from being applied to front cover 24 and back cover 22. Recirculation check valves 78 also isolate the high pressure within supply chambers 98 from the supply pressure of oil source 104. Oil continues to be supplied to advance chambers 42 from retard chambers 44 until rotor 20 is rotationally displaced sufficiently far for each valve spool land 96 to again align with respective rotor advance passages 74 and rotor retard passages 76 as shown in FIG. 5B, thereby again preventing fluid communication into and out of advance chambers 42 and retard chambers 44 and hydraulically locking the rotational position of rotor 20 relative to stator 18. In FIGS. 5C and 5D, which are the same cross-sectional views of FIGS. 2, and 5A respectively, the reference numbers have been removed for clarity, and arrows R have been included to represent oil that is being recirculated for rotating rotor 20 relative to stator 18. It should be noted that FIG. 5C shows recirculation check valve 78 being opened, but recirculation check valves 78 may also be closed depending on the direction of the torque reversal of camshaft 14 at a particular time.

It is important to note that oil exclusively flows from supply chambers 98 to whichever of advance chambers 42 and retard chambers 44 need to increase in volume in order to achieve the desired phase relationship of rotor 20 relative to stator 18 while oil exclusively flows to vent chambers 100 from whichever of advance chambers 42 and retard chambers 44 need to decrease in volume in order to achieve the desired phase relationship of rotor 20 relative to stator 18. In this way, only one set of recirculation check valves 78 are needed, acting in one direction within valve spool 28 in order to achieve the desired phase relationship of rotor 20 relative to stator 18. Consequently, it is not necessary to switch between sets of check valves operating in opposite flow directions or switch between an advancing circuit and a retarding circuit. In the case of the position control valve described herein, a unidirectional flow circuit is defined within valve spool 28 when valve spool 28 is moved to a position within rotor 20 to allow either flow from advance chambers 42 to retard chambers 44 or from retard chambers 44 to advance chambers 42 where the flow circuit prevents flow in the opposite directions. Consequently, the flow circuit is defined by valve spool 28 which is simple in construction and low cost to produce.

In operation, the actual rotational position of rotor 20 relative to stator 18 may drift over time from the desired rotational position of rotor 20 relative to stator 18, for example only, due to leakage from advance chambers 42 and/or retard chambers 44. Leakage from advance chambers 42 and/or retard chambers 44 may be the result of, by way of non-limiting example only, manufacturing tolerances or wear of the various components of camshaft phaser 12. An important benefit of valve spool 28 is that valve spool 28 allows for self-correction of the rotational position of rotor 20 relative to stator 18 if the rotational position of rotor 20 relative to stator 18 drifts from the desired rotational position of rotor 20 relative to stator 18. Since the rotational position of valve spool 28 relative to stator 18 is locked by actuator 118, rotor advance passages 74 and rotor retard passages 76 will be moved out of alignment with valve spool lands 96 when rotor 20 drifts relative to stator 18. Consequently, oil will flow to advance chambers 42 from retard chambers 44 and oil will flow from advance chambers 42 to retard chambers 44 as necessary to rotate rotor 20 relative to stator 18 to correct for the drift until each valve spool land 96 is again aligned with respective rotor advance passages 74 and rotor retard passages 76.

It should be noted that oil that may leak from camshaft phaser 12 is replenished from oil provided by oil source 104. Replenishing oil is accomplished by oil source 104 supplying oil to recirculation chamber 68 via camshaft supply passage 108, rotor supply passage 106, oil make-up chamber 92, oil make-up passages 102, vent chambers 100, and spool vent passages 112. From recirculation chamber 68, the oil may be supplied to advance chambers 42 or retard chambers 44 as necessary by one or more of the processes described previously for advancing, retarding, or correcting for drift.

While clockwise rotation of rotor 20 relative to stator 18 respectively has been described as advancing camshaft 14 and counterclockwise rotation of rotor 20 relative to stator 18 has been described as retarding camshaft 14, it should now be understood that this relationship may be reversed depending on whether camshaft phaser 12 is mounted to the front of internal combustion engine 10 (shown in the figures) or to the rear of internal combustion engine 10.

Figure 6:
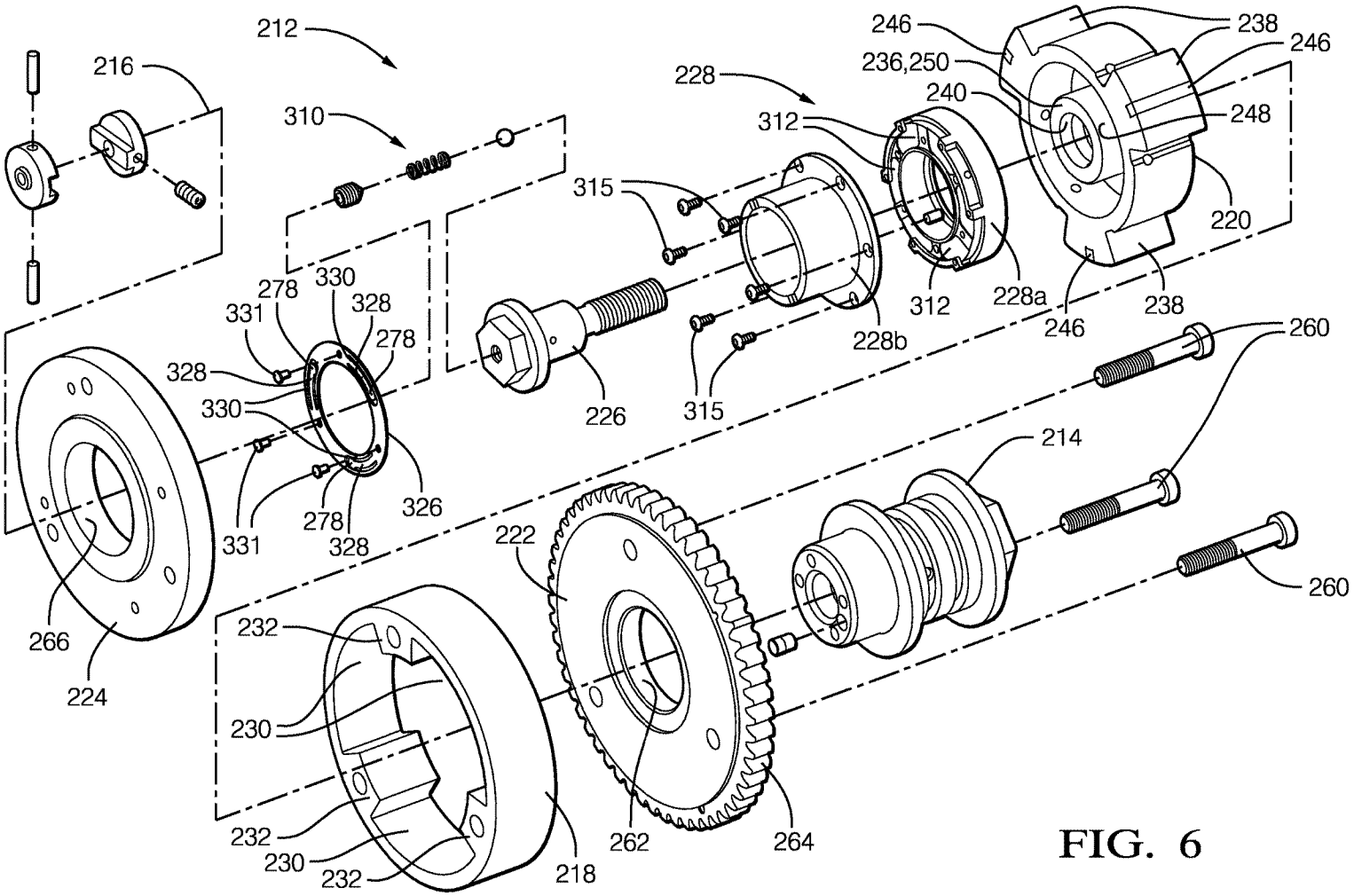
FIG. 6 is an exploded isometric view of another camshaft phaser in accordance with the present invention.
Figure 7:
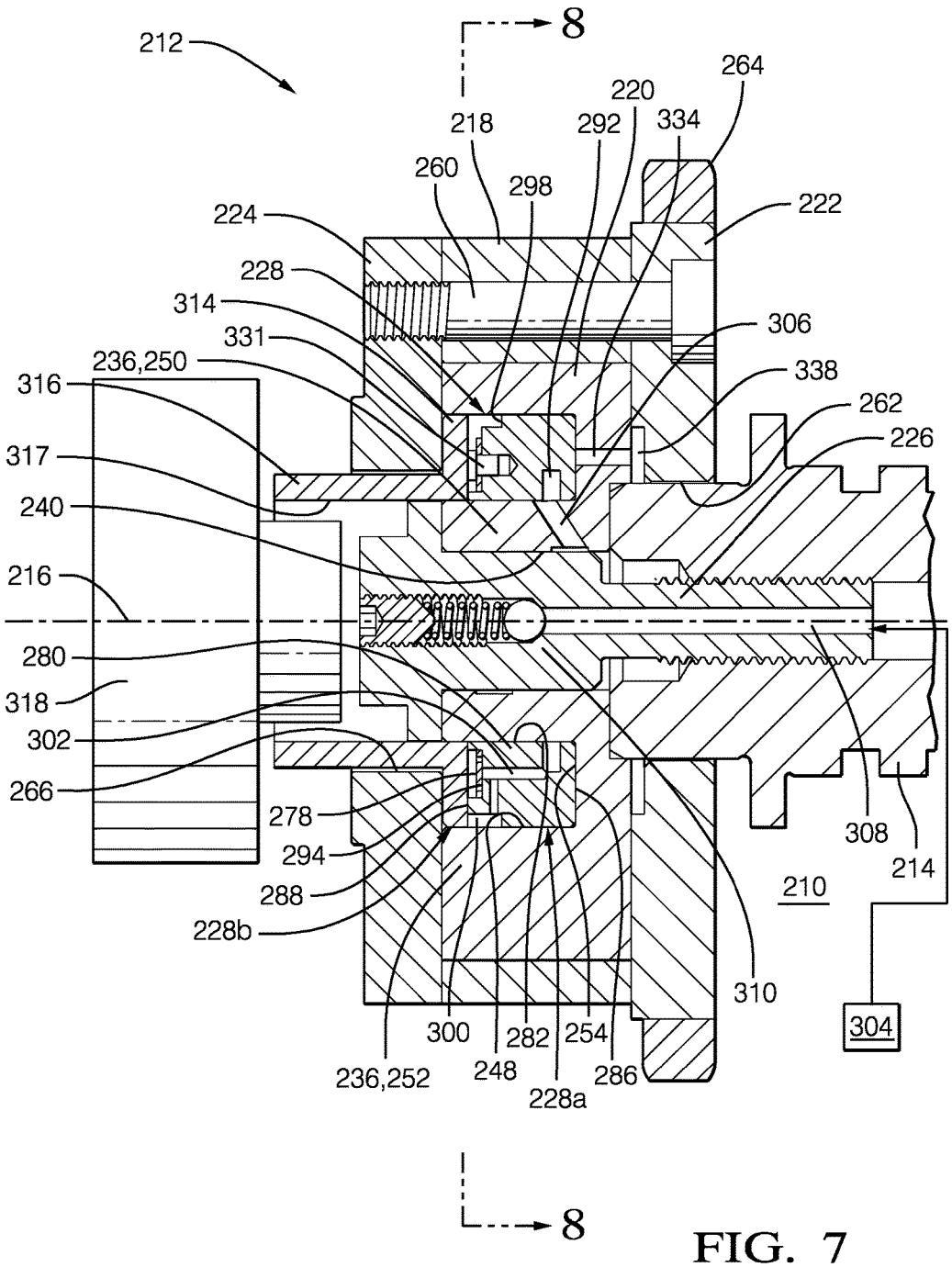
FIG. 7 is an axial cross-section view of the camshaft phaser of FIG. 6.
Figure 8:
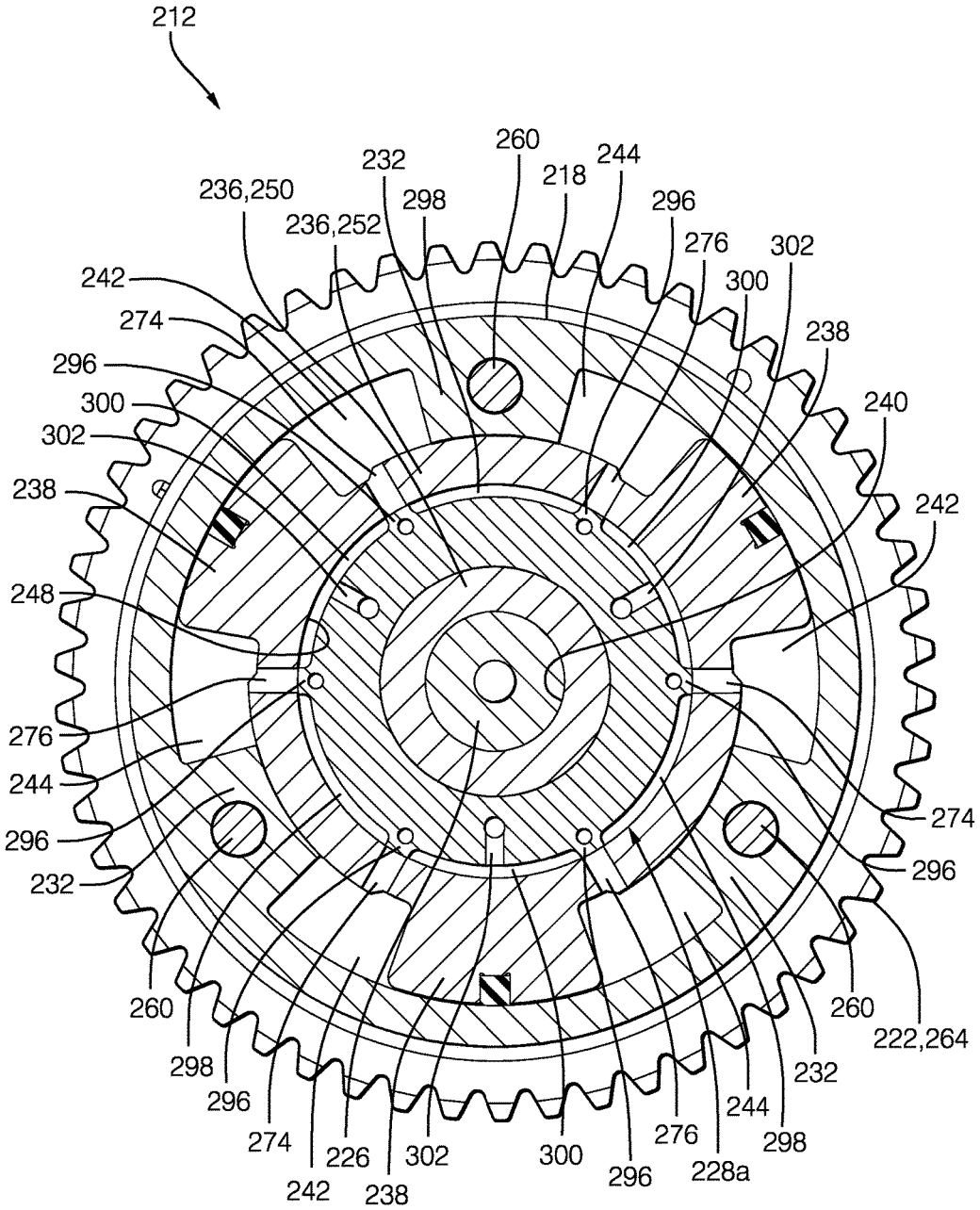
FIG. 8 is a radial cross-sectional view of the camshaft phaser taken through section line 8-8 of FIG. 7 and showing a valve spool of the camshaft phaser in a hold position which maintains a rotational position of a rotor of the camshaft phaser relative to a stator of the camshaft phaser.

In accordance with another preferred embodiment of this invention and referring to FIGS. 6-8, an internal combustion engine 210 is shown which includes a camshaft phaser 212. Internal combustion engine 210 also includes a camshaft 214 which is rotatable about a camshaft axis 216 based on rotational input from a crankshaft and chain (not shown) driven by a plurality of reciprocating pistons (also not shown). As camshaft 214 is rotated, it imparts valve lifting and closing motion to intake and/or exhaust valves (not shown) as is well known in the internal combustion engine art. Camshaft phaser 212 allows the timing or phase between the crankshaft and camshaft 214 to be varied. In this way, opening and closing of the intake and/or exhaust valves can be advanced or retarded in order to achieve desired engine performance.

Camshaft phaser 212 generally includes a stator 218 which acts as an input member, a rotor 220 disposed coaxially within stator 218 which acts as an output member, a back cover 222 closing off one axial end of stator 218, a front cover 224 closing off the other axial end of stator 218, a camshaft phaser attachment bolt 226 for attaching camshaft phaser 212 to camshaft 214, and a valve spool 228. The rotational position of valve spool 228 relative to stator 218 determines the rotational position of rotor 220 relative to stator 218, unlike typical valve spools which move axially to determine only the direction the rotor will rotate relative to the stator. The various elements of camshaft phaser 212 will be described in greater detail in the paragraphs that follow.

Stator 218 is generally cylindrical and includes a plurality of radial chambers 230 defined by a plurality of lobes 232 extending radially inward. In the embodiment shown, there are three lobes 232 defining three radial chambers 230, however, it is to be understood that a different number of lobes 232 may be provided to define radial chambers 230 equal in quantity to the number of lobes 232.

Rotor 220 includes a rotor central hub 236 with a plurality of vanes 238 extending radially outward therefrom and a rotor central through bore 240 extending axially therethrough. The number of vanes 238 is equal to the number of radial chambers 230 provided in stator 218. Rotor 220 is coaxially disposed within stator 218 such that each vane 238 divides each radial chamber 230 into advance chambers 242 and retard chambers 244. The radial tips of lobes 232 are mateable with rotor central hub 236 in order to separate radial chambers 230 from each other. Each of the radial tips of vanes 238 may include one of a plurality of wiper seals 246 to substantially seal adjacent advance chambers 242 and retard chambers 244 from each other. While not shown, each of the radial tips of lobes 232 may also include one of a plurality of wiper seals 246.

Rotor central hub 236 defines an annular valve spool recess 248 which extends part way into rotor central hub 236 from the axial end of rotor central hub 236 that is proximal to front cover 224. As a result, rotor central hub 236 includes a rotor central hub inner portion 250 that is annular in shape and bounded radially inward by rotor central through bore 240 and bounded radially outward by annular valve spool recess 248. Also as a result, rotor central hub 236 includes a rotor central hub outer portion 252 that is bounded radially inward by annular valve spool recess 248 and is bounded radially outward by the radially outward portion of rotor central hub outer portion 252 from which lobes 232 extend radially outward. Since annular valve spool recess 248 extends only part way into rotor central hub 236, annular valve spool recess 248 defines an annular valve spool recess bottom 254 which is annular in shape and extends between rotor central hub inner portion 250 and rotor central hub outer portion 252.

Back cover 222 is sealingly secured, using cover bolts 260, to the axial end of stator 218 that is proximal to camshaft 214. Tightening of cover bolts 260 prevents relative rotation between back cover 222 and stator 218. Back cover 222 includes a back cover central bore 262 extending coaxially therethrough. The end of camshaft 214 is received coaxially within back cover central bore 262 such that camshaft 214 is allowed to rotate relative to back cover 222. Back cover 222 may also include a sprocket 264 formed integrally therewith or otherwise fixed thereto. Sprocket 264 is configured to be driven by a chain that is driven by the crankshaft of internal combustion engine 210. Alternatively, sprocket 264 may be a pulley driven by a belt or other any other known drive member known for driving camshaft phaser 212 by the crankshaft. In an alternative arrangement, sprocket 264 may be integrally formed or otherwise attached to stator 218 rather than back cover 222.

Similarly, front cover 224 is sealingly secured, using cover bolts 260, to the axial end of stator 218 that is opposite back cover 222. Cover bolts 260 pass through back cover 222 and stator 218 and threadably engage front cover 224; thereby clamping stator 218 between back cover 222 and front cover 224 to prevent relative rotation between stator 218, back cover 222, and front cover 224. In this way, advance chambers 242 and retard chambers 244 are defined axially between back cover 222 and front cover 224. Front cover 224 includes a front cover central bore 266 extending coaxially therethrough.

Camshaft phaser 212 is attached to camshaft 214 with camshaft phaser attachment bolt 226 which extends coaxially through rotor central through bore 240 of rotor 220 and threadably engages camshaft 214, thereby clamping rotor 220 securely to camshaft 214. More specifically, rotor central hub inner portion 250 is clamped between the head of camshaft phaser attachment bolt 226 and camshaft 214. In this way, relative rotation between stator 218 and rotor 220 results in a change in phase or timing between the crankshaft of internal combustion engine 210 and camshaft 214.

Oil is selectively transferred to advance chambers 242 from retard chambers 244, as result of torque applied to camshaft 214 from the valve train of internal combustion engine 210, i.e. torque reversals of camshaft 214, in order to cause relative rotation between stator 218 and rotor 220 which results in retarding the timing of camshaft 214 relative to the crankshaft of internal combustion engine 210. Conversely, oil is selectively transferred to retard chambers 244 from advance chambers 242, as result of torque applied to camshaft 214 from the valve train of internal combustion engine 210, in order to cause relative rotation between stator 218 and rotor 220 which results in advancing the timing of camshaft 214 relative to the crankshaft of internal combustion engine 210. Rotor advance passages 274 may be provided in rotor 220 for supplying and venting oil to and from advance chambers 242 while rotor retard passages 276 may be provided in rotor 220 for supplying and venting oil to and from retard chambers 244. Rotor advance passages 274 extend radially outward through rotor central hub outer portion 252 from annular valve spool recess 248 to advance chambers 242 while rotor retard passages 276 extend radially outward through rotor central hub outer portion 252 from annular valve spool recess 248 to retard chambers 244. Transferring oil to advance chambers 242 from retard chambers 244 and transferring oil to retard chambers 244 from advance chambers 242 is controlled by valve spool 228 and recirculation check valves 278, as will be described in detail later, such that valve spool 228 is disposed coaxially and rotatably within annular valve spool recess 248.

Rotor 220 and valve spool 228, which act together to function as a valve, will now be described in greater detail with continued reference to FIGS. 6-8. Valve spool 228 is a multi-piece assembly which includes a valve spool inner portion 228*a* and a valve spool outer portion 228*b*. Valve spool inner portion 228*a* includes a spool central hub 280 with a spool central through bore 282 extending coaxially therethrough. Valve spool inner portion 228*a* is received coaxially within annular valve spool recess 248 such that valve spool inner portion 228*a* abuts valve spool recess bottom 254 and such that valve spool inner portion 228*a* radially surrounds camshaft phaser attachment bolt 226. Spool central through bore 282 is sized to mate with rotor central hub inner portion 250 in a close sliding interface such that valve spool 228 is able to freely rotate on rotor central hub inner portion 250 while substantially preventing oil from passing between the interface of spool central through bore 282 and rotor central hub inner portion 250 and also substantially preventing radial movement of valve spool 228 within annular valve spool recess 248. The outer circumference of valve spool inner portion 228*a* is sized to mate with rotor central hub outer portion 252 in a close sliding interface such that valve spool 228 is able to freely rotate within annular valve spool recess 248 while substantially preventing oil from passing between the interface of valve spool inner portion 228*a* and rotor central hub outer portion 252. Spool central hub 280 extends axially from a spool hub first end 286 which is proximal to valve spool recess bottom 254 to a spool hub second end 288 which is distal from valve spool recess bottom 254. Valve spool inner portion 228*a* includes an oil make-up groove 292 which extends radially outward from spool central through bore 282 such that oil make-up groove 292 is annular in shape. A recirculation chamber 294 that is annular in shape is formed in the axial end of valve spool inner portion 228*a* that mates with valve spool outer portion 228*b*. A plurality of supply chambers 298 and a plurality of vent chambers 300 are formed in an alternating pattern in the outer circumference of valve spool inner portion 228*a* such that adjacent supply chambers 298 and vent chambers 300 are separated by respective valve spool lands 296 which are sized to be about the same width as rotor advance passages 274 and rotor retard passages 276. Each supply chamber 298 and each vent chamber 300 extends axially part way along the length of valve spool inner portion 228*a* from the axial end of valve spool inner portion 228*a* that mates with valve spool outer portion 228*b*. Fluid communication between recirculation chamber 294 and vent chambers 300 is provided by a plurality of valve spool recirculation passages 302 formed in valve spool inner portion 228*a* such that each valve spool recirculation passage 302 extends radially inward from a respective vent chamber 300, then axially to recirculation chamber 294. Recirculation check valves 278 allow oil to flow from vent chambers 300 to supply chambers 298 while preventing oil from flowing from supply chambers 298 to vent chambers 300 as will be described in greater detail later. Valve spool recirculation passages 302 also extend to oil make-up groove 292 which receives pressurized oil from an oil source 304, for example, an oil pump of internal combustion engine 210, via a rotor supply passage 306 formed in rotor 220 and also via bolt supply passage 308 formed in camshaft phaser attachment bolt 226. An oil make-up check valve 310 is located within bolt supply passage 308 in order to prevent oil from back-flowing from oil make-up groove 292 to oil source 304 while allowing oil to be supplied to oil make-up groove 292 from oil source 304. Fluid communication between recirculation chamber 294 and supply chambers 298 is provided by a plurality of recirculation recesses 312 formed in the axial face of valve spool inner portion 228*a* that mates with valve spool outer portion 228*b*.

Valve spool outer portion 228*b* includes a valve spool outer portion base 314 located axially between valve spool inner portion 228*a* and front cover 24 and also includes a valve spool drive extension 316 which extends axially away from valve spool outer portion base 314 and through front cover central bore 266. Valve spool outer portion base 314 is annular in shape and sized to mate radially with rotor central hub outer portion 254 in a close sliding interface such that valve spool outer portion base 314 is able to freely rotate within annular valve spool recess 248 while substantially preventing oil from passing between the interface of valve spool outer portion base 314 and annular valve spool recess 248. Valve spool outer portion 228*b* also includes a valve spool outer portion central through bore 317 which extends axially therethrough such that valve spool outer portion central through bore 317 is centered about camshaft axis 216. Valve spool outer portion central through bore 317 is sized to mate radially with rotor central hub inner portion 250 in a close sliding interface such that valve spool outer portion base 314 is able to freely rotate relative to camshaft phaser rotor 220 while substantially preventing oil from passing between the interface of valve spool outer portion central through bore 317 and rotor central hub inner portion 250. Valve spool outer portion 228*b* is sealingly secured to valve spool inner portion 228*a* with valve spool screws 315 which extend through valve spool outer portion base 314 and threadably engage valve spool inner portion 228*a*, thereby substantially preventing oil from passing between the interface of valve spool outer portion base 314 and valve spool inner portion 228*a* and rotationally fixing valve spool inner portion 228*a* to valve spool outer portion 228*b*. Fixing valve spool outer portion 228*b* to valve spool inner portion 228*a* also prevents axial pressure from generating a thrust load between valve spool 228 and front cover 224 and also between valve spool 228 and rotor 220. Valve spool drive extension 316 is arranged to engage an actuator 318 which is used to rotate valve spool 228 relative to stator 218 and rotor 220 as required to achieve a desired rotational position of rotor 220 relative to stator 218 as will be described in greater detail later. Actuator 318 may be, by way of non-limiting example only, an electric motor which is stationary relative to internal combustion engine 210 and connected to valve spool drive extension 316 through a gear set or an electric motor which rotates with camshaft phaser 212 and which is powered through slip rings. One such actuator and gear set is show in U.S. patent application Ser. No. 14/613,630 to Haltiner filed on Feb. 4, 2015, the disclosure of which is incorporated herein by reference in its entirety. Actuator 318 may be controlled by an electronic controller (not shown) based on inputs from various sensors (not shown) which may provide signals indicative of, by way of non-limiting example only, engine temperature, ambient temperature, intake air flow, manifold pressure, exhaust constituent composition, engine torque, engine speed, throttle position, crankshaft position, and camshaft position. Based on the inputs from the various sensors, the electronic controller may determine a desired phase relationship between the crankshaft and camshaft 214, thereby commanding actuator 318 to rotate valve spool 228 relative to stator 218 and rotor 220 as required to achieve the desired rotational position of rotor 220 relative to stator 218.

Each recirculation check valve 278 may be integrally formed as part of a recirculation check valve plate 326 which is annular in shape and sized to fit within recirculation chamber 294 such that the thickness of recirculation check valve plate 326 is less than the depth of recirculation chamber 294. Each recirculation check valve 278 may be located at the free end of a recirculation check valve arm 328 which is defined by a recirculation check valve slot 330 formed through recirculation check valve plate 326. Recirculation check valve arms 328 are resilient and compliant such that recirculation check valve arms 328 recirculation check valves 278 toward seating with valve spool inner portion 228*a*. In this way, each recirculation check valve 278 acts as a reed valve that opens into recirculation chamber 294 and can be easily and economically formed, by way of non-limiting example only, by stamping sheet metal stock, i.e. recirculation check valves 278, recirculation check valve plate 326, and recirculation check valve arms 328 can be integrally formed as a single piece. Recirculation check valve plate 326 may be radially indexed and retained within recirculation chamber 294 by recirculation check valve plate screws 331 which extend through recirculation check valve plate 326 and threadably engage valve spool inner portion 228*a*.

Rotor 220 may include a rotor vent passage 334 in order to vent oil that may leak to be axially between valve spool inner portion 228*a* and valve spool recess bottom 254. Rotor vent passage 334 extends through rotor 220 from valve spool recess bottom 254 to the face of rotor 220 that faces toward back cover 222. Back cover 222 includes a back cover annular recess 338 which faces toward rotor 220 and extends radially inward from back cover central bore 262. Oil that is communicated to back cover annular recess 338 is allowed to escape between the radial clearance between camshaft 214 and back cover central bore 262. Similarly, oil that may leak to be axially between valve spool outer portion 228*b* and front cover 224 is allowed to escape between the radial clearance between front cover central bore 266 and valve spool drive extension 316. In this way, opposing axial faces of valve spool inner portion 228*a* and valve spool outer portion 228*b* are vented, thereby preventing an unbalanced axial force from being applied to valve spool 228.

Operation of camshaft phaser 212 will now be described with continued reference to FIGS. 6-8 and now with additional reference to FIGS. 9A-10D. The rotational position of rotor 220 relative to stator 218 is determined by the rotational position of valve spool 228 relative to stator 218. When the rotational position of rotor 220 relative to stator 218 is at a desired position to achieve desired operational performance of internal combustion engine 210, the rotational position of valve spool 228 relative to stator 218 is maintained constant by actuator 318. Consequently, a hold position as shown in FIG. 8 is defined when each valve spool land 296 is aligned with a respective rotor advance passage 274 or a respective rotor retard passage 276, thereby preventing fluid communication into and out of advance chambers 242 and retard chambers 244 and hydraulically locking the rotational position of rotor 220 relative to stator 218. In this way, the phase relationship between camshaft 214 and the crankshaft is maintained.

Figure 9A:
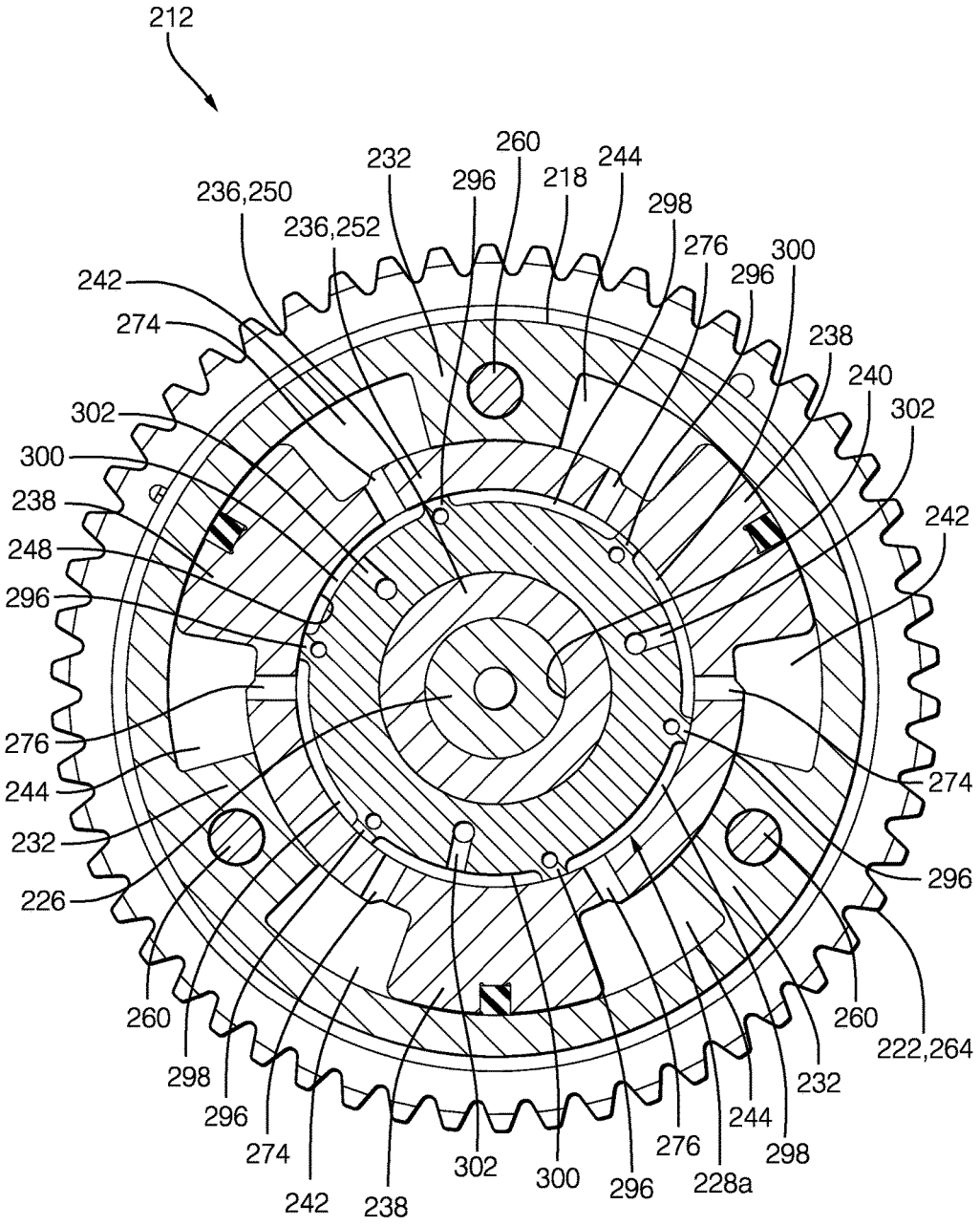
FIG. 9A is a radial cross-sectional view of the camshaft phaser taken through section line 8-8 of FIG. 7 showing the valve spool in a position which will result in a clockwise rotation of the rotor relative to the stator.
Figure 9B:
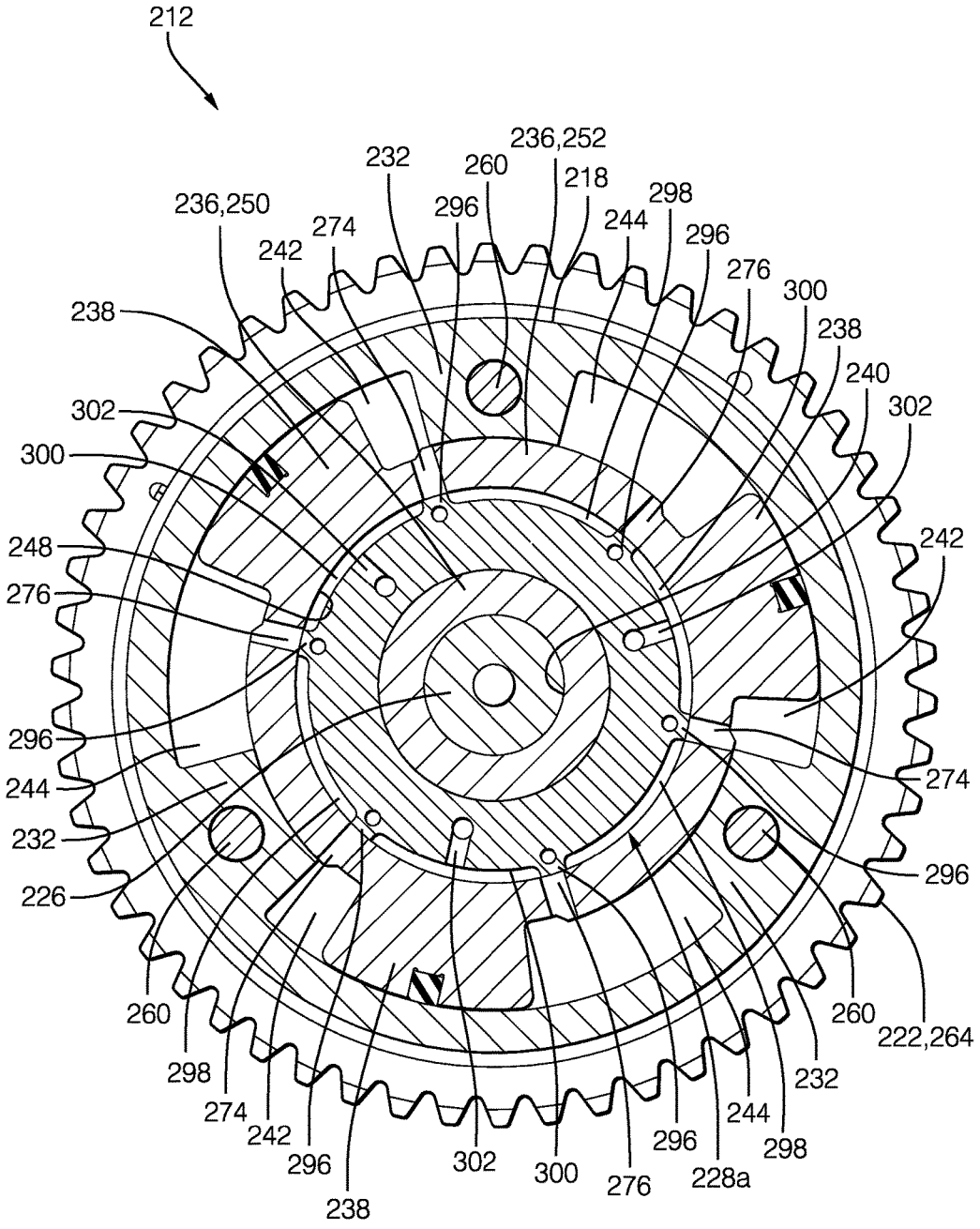
FIG. 9B is a radial cross-sectional view of the camshaft phaser taken through section line 8-8 of FIG. 7 showing the rotor after being rotated clockwise as a result of the position of the valve spool as shown in FIG. 9A.
Figure 9C:
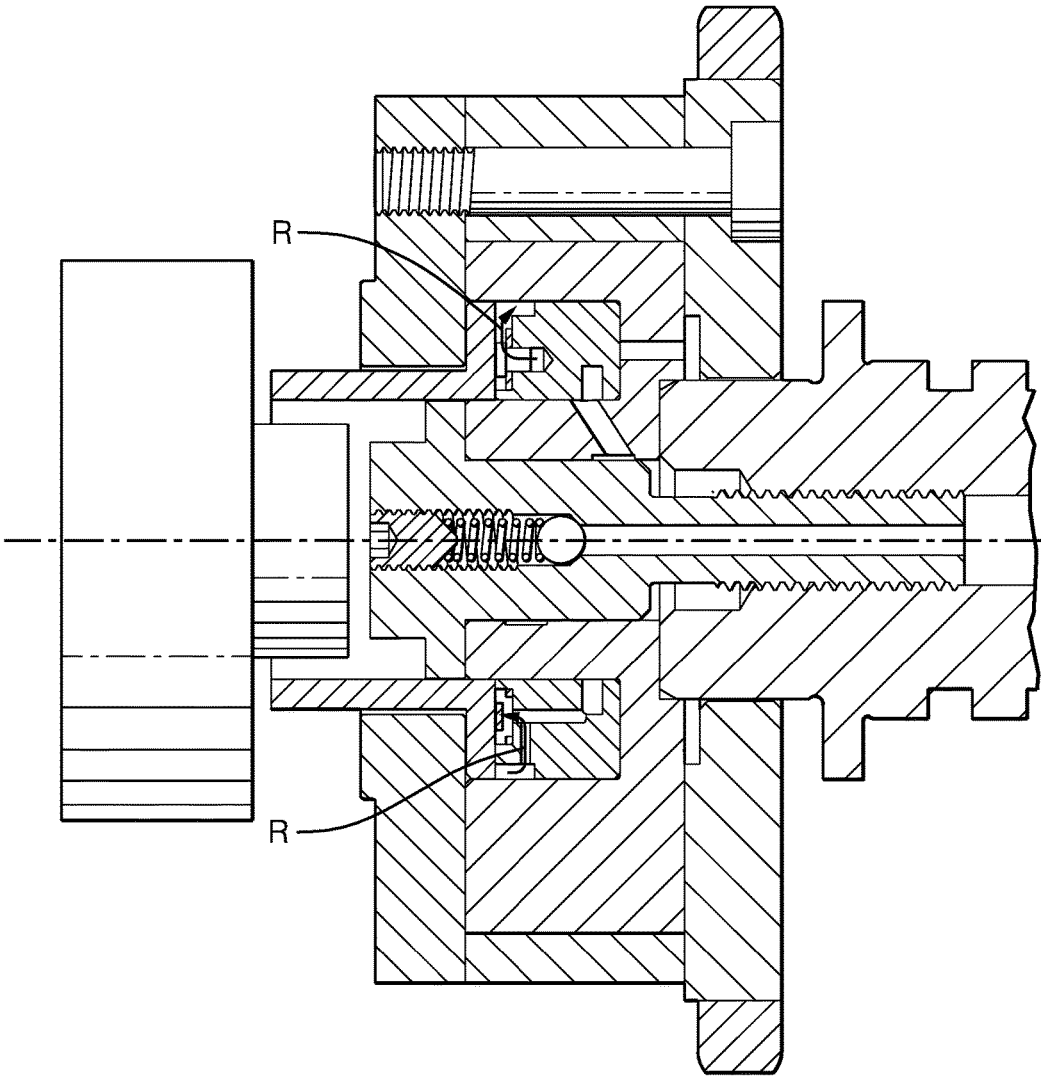
FIG. 9C is the axial cross-sectional view of FIG. 7 with reference numbers removed in order to clearly shown the path of oil flow as a result of the position of the valve spool as shown in FIG. 9A.
Figure 9D:
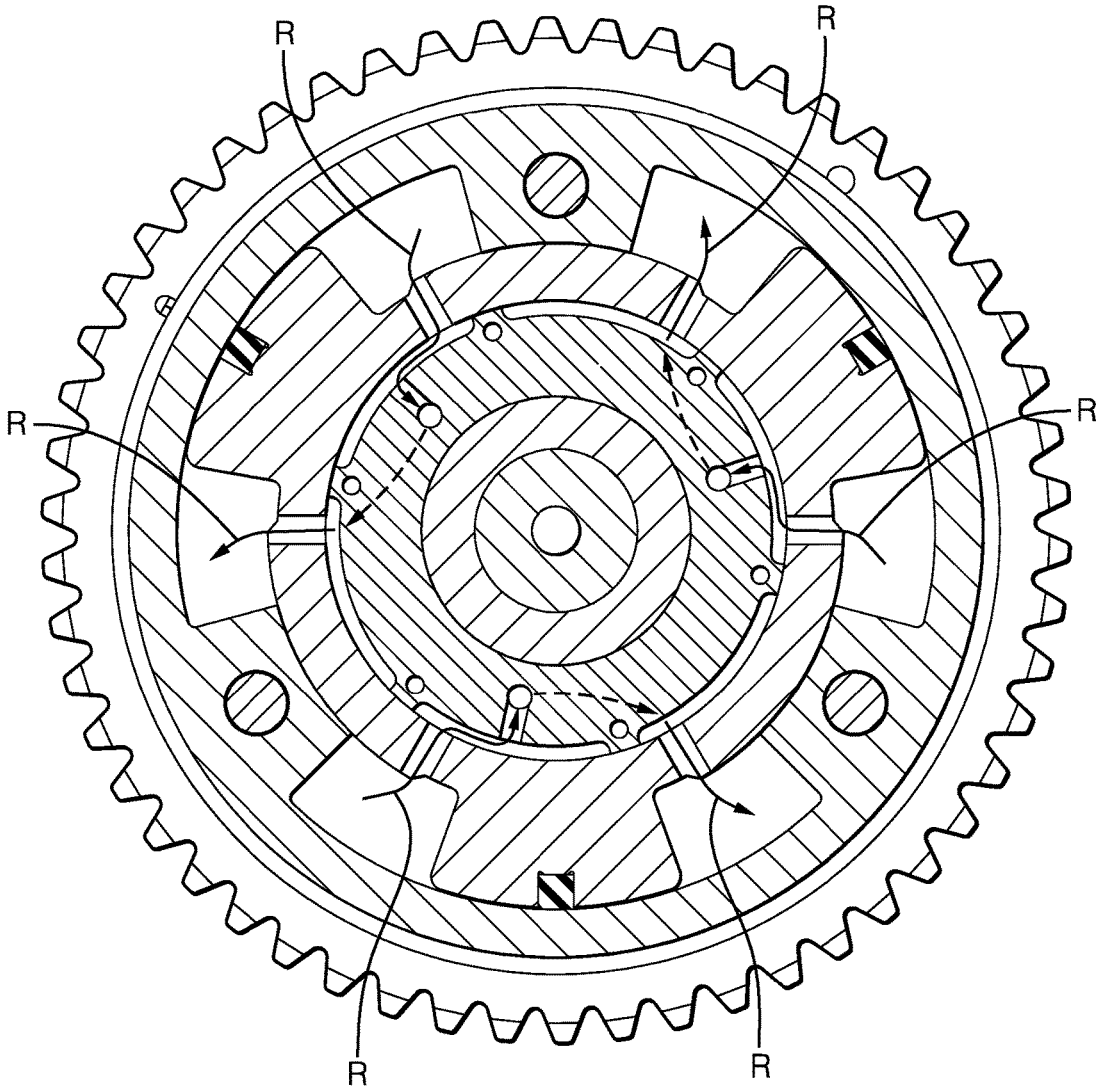
FIG. 9D is the radial cross-sectional view of FIG. 9A with reference numbers removed in order to clearly shown the path of oil flow as a result of the position of the valve spool as shown in FIG. 9A.

As shown in FIGS. 9A-9D, if a determination is made to advance the phase relationship between camshaft 214 and the crankshaft, it is necessary to rotate rotor 220 clockwise relative to stator 218 as viewed in the figures and as embodied by camshaft phaser 212. In order to rotate rotor 220 to the desired rotational position relative to stator 218, actuator 318 causes valve spool 228 to rotate clockwise relative to stator 218 to a rotational position of valve spool 228 relative to stator 218 that will also determine the rotational position of rotor 220 relative to stator 218. When valve spool 228 is rotated clockwise relative to stator 218, valve spool lands 296 are moved out of alignment with rotor advance passages 274 and rotor retard passages 276, thereby providing fluid communication between supply chambers 298 and retard chambers 244 and also between vent chambers 300 and advance chambers 242. Consequently, torque reversals of camshaft 214 which tend to pressurize oil within advance chambers 242 cause oil to be communicated from advance chambers 242 to retard chambers 244 via rotor advance passages 274, vent chambers 300, valve spool recirculation passages 302, recirculation chamber 294, recirculation recesses 312, supply chambers 298, and rotor retard passages 276. However, torque reversals of camshaft 214 which tend to pressurize oil within retard chambers 244 and apply a counterclockwise torque to rotor 220 are prevented from venting oil from retard chambers 244 because recirculation check valves 278 prevent oil from flowing out of supply chambers 298 and being supplied to advance chambers 242. It should be noted that torque reversals of camshaft 214 which apply a counterclockwise torque to rotor 220 results in high pressure being generated within supply chambers 298 and recirculation chamber 294; however, the high pressure is contained within supply chambers 298 and recirculation chamber 294, thereby preventing axial loading from being applied to front cover 224 and back cover 222. It should also be noted that recirculation check valves 278 isolate the high pressure within supply chambers 298 and recirculation chamber 294 from the supply pressure of oil source 304. Oil continues to be supplied to retard chambers 244 from advance chambers 242 until rotor 220 is rotationally displaced sufficiently far for each valve spool land 296 to again align with respective rotor advance passages 274 and rotor retard passages 276 as shown in FIG. 9B, thereby again preventing fluid communication into and out of advance chambers 242 and retard chambers 244 and hydraulically locking the rotational position of rotor 220 relative to stator 218. In FIGS. 9C and 9D, which are the same cross-sectional views of FIGS. 7 and 9A respectively, the reference numbers have been removed for clarity, and arrows R have been included to represent oil that is being recirculated for rotating rotor 220 relative to stator 218. It should be noted that FIG. 9C shows recirculation check valve 278 being opened, but recirculation check valves 278 may also be closed depending on the direction of the torque reversal of camshaft 214 at a particular time.

Figure 10A:
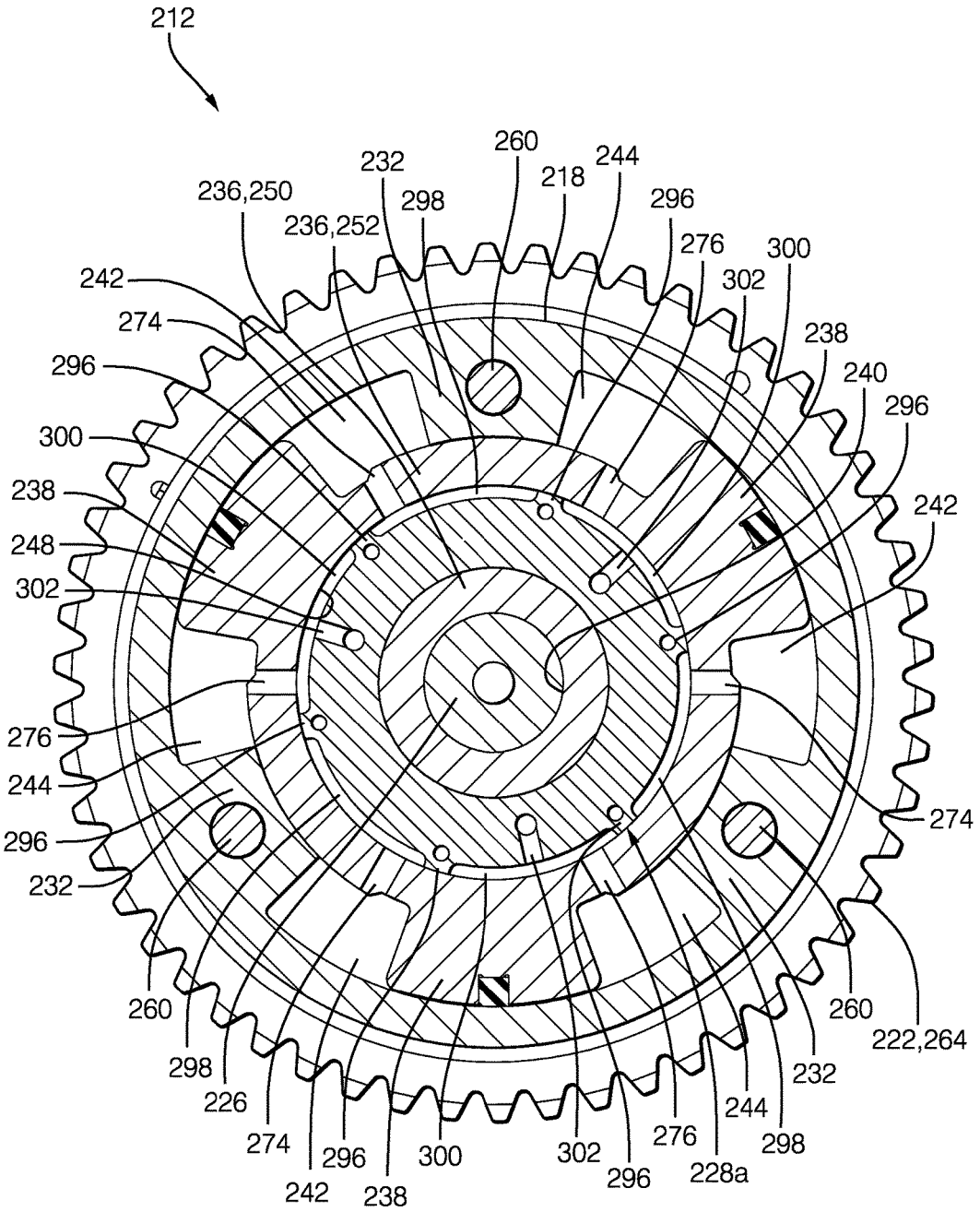
FIG. 10A is a radial cross-sectional view of the camshaft phaser taken through section line 8-8 of FIG. 7 showing the valve spool in a position which will result in a counterclockwise rotation of the rotor relative to the stator.
Figure 10B:
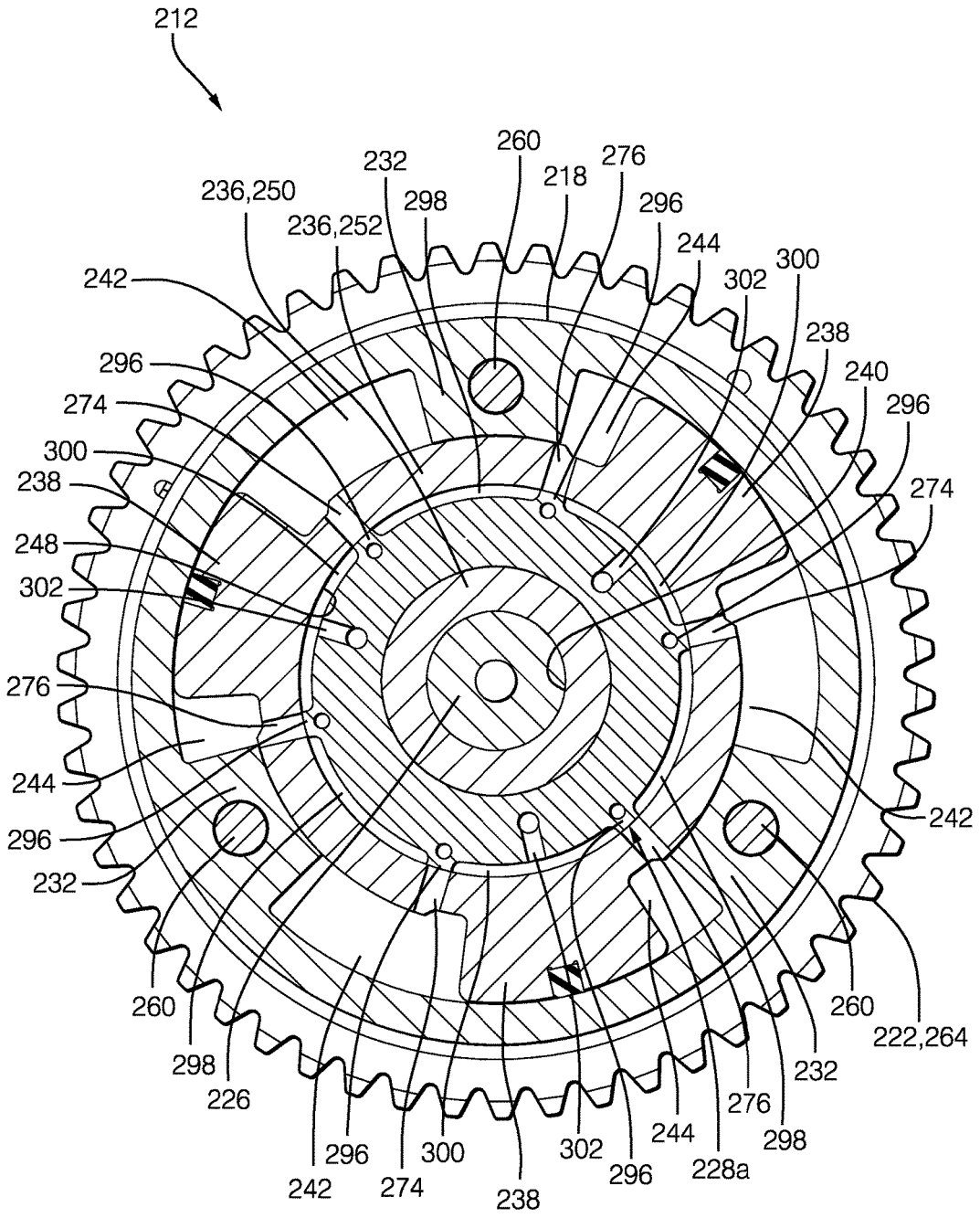
FIG. 10B is a radial cross-sectional view of the camshaft phaser taken through section line 8-8 of FIG. 7 showing the rotor after being rotated counterclockwise as a result of the position of the valve spool as shown in FIG. 10A.
Figure 10C:
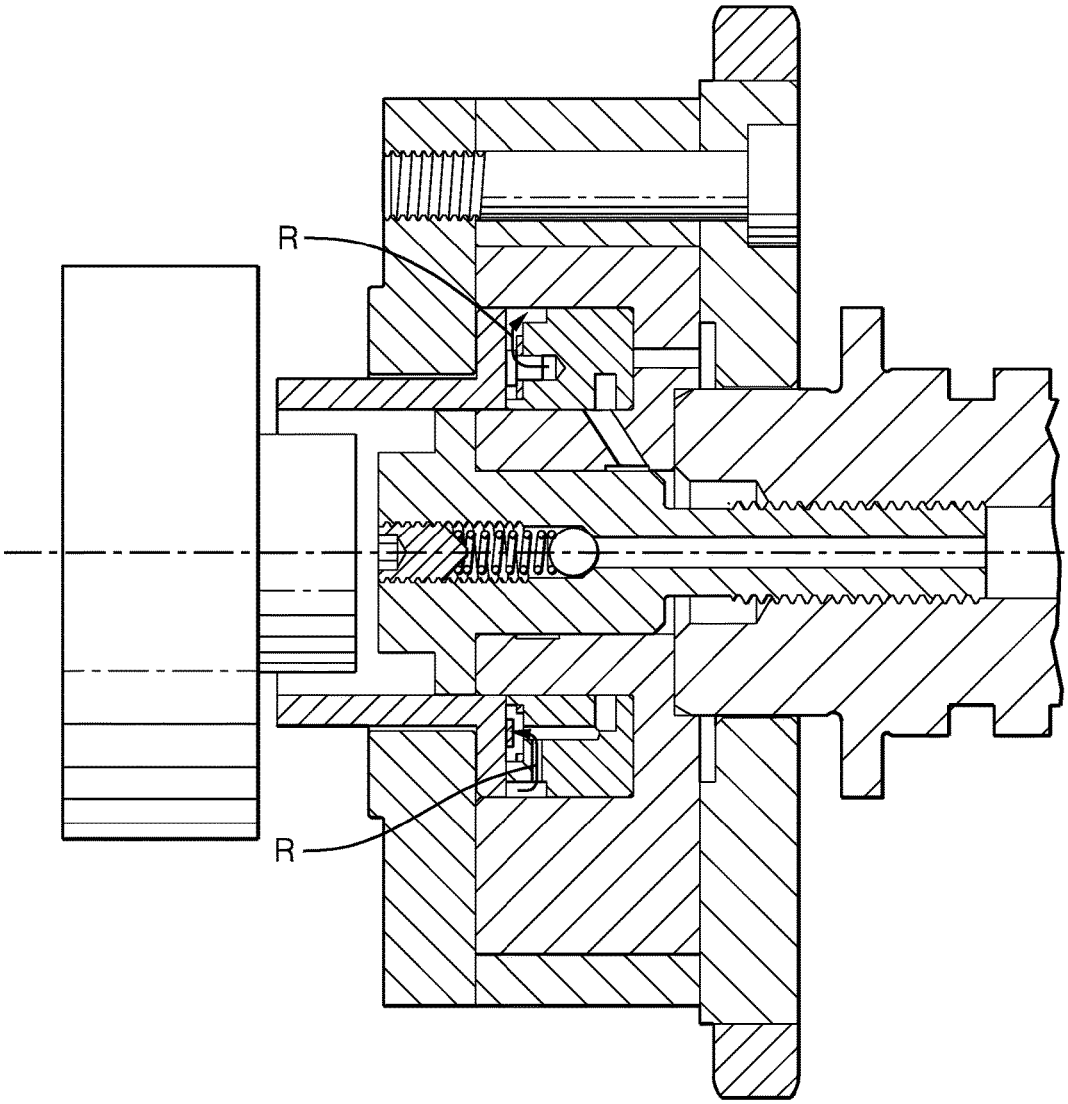
FIG. 10C is the axial cross-sectional view of FIG. 7 with reference numbers removed in order to clearly shown the path of oil flow as a result of the position of the valve spool as shown in FIG. 10A.
Figure 10D:
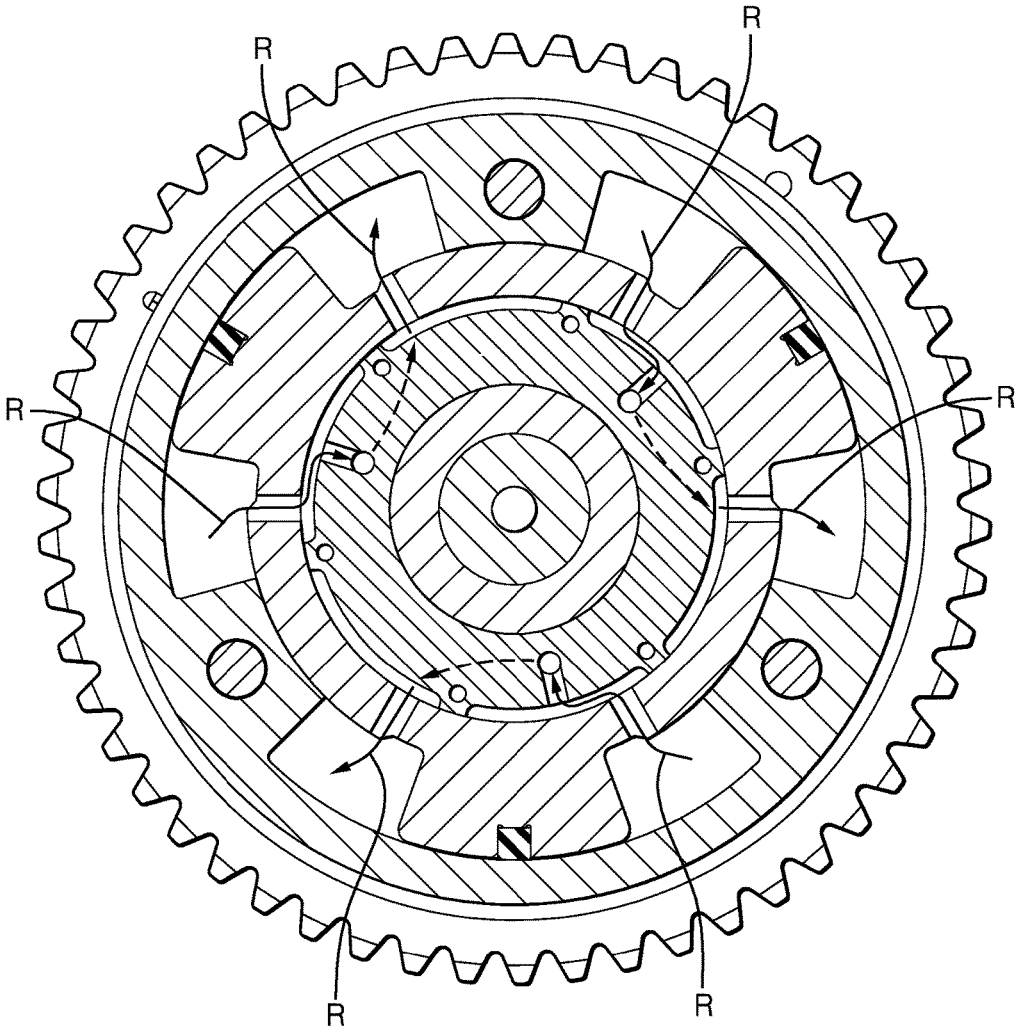
FIG. 10D is the radial cross-sectional view of FIG. 10A with reference numbers removed in order to clearly shown the path of oil flow as a result of the position of the valve spool as shown in FIG. 10A.

Conversely, as shown in FIGS. 10A-10D, if a determination is made to retard the phase relationship between camshaft 214 and the crankshaft, it is necessary to rotate rotor 220 counterclockwise relative to stator 218 as viewed in the figures and as embodied by camshaft phaser 212. In order to rotate rotor 220 to the desired rotational position relative to stator 218, actuator 318 causes valve spool 228 to rotate counterclockwise relative to stator 218 to a rotational position of valve spool 228 relative to stator 218 that will also determine the rotational position of rotor 220 relative to stator 218. When valve spool 228 is rotated counterclockwise relative to stator 218, valve spool lands 296 are moved out of alignment with rotor advance passages 274 and rotor retard passages 276, thereby providing fluid communication between supply chambers 298 and advance chambers 242 and also between vent chambers 300 and retard chambers 244. Consequently, torque reversals of camshaft 214 which tend to pressurize oil within retard chambers 244 cause oil to be communicated from retard chambers 244 to advance chambers 242 via rotor retard passages 276, vent chambers 300, valve spool recirculation passages 302, recirculation chamber 294, recirculation recesses 312, supply chambers 298, and rotor advance passages 274. However, torque reversals of camshaft 214 which tend to pressurize oil within advance chambers 242 and apply a clockwise torque to rotor 220 are prevented from venting oil from advance chambers 242 because recirculation check valves 278 prevent oil from flowing out of supply chambers 298 and being supplied to retard chambers 244. It should be noted that torque reversals of camshaft 214 which apply a clockwise torque to rotor 220 results in high pressure being generated within supply chambers 298 and recirculation chamber 294; however, the high pressure is contained within supply chambers 298 and recirculation chamber 294, thereby preventing axial loading from being applied to front cover 224 and back cover 222. It should also be noted that recirculation check valves 278 isolate the high pressure within supply chambers 298 and recirculation chamber 294 from the supply pressure of oil source 304. Oil continues to be supplied to advance chambers 242 from retard chambers 244 until rotor 220 is rotationally displaced sufficiently far for each valve spool land 296 to again align with respective rotor advance passages 274 and rotor retard passages 276 as shown in FIG. 10B, thereby again preventing fluid communication into and out of advance chambers 242 and retard chambers 244 and hydraulically locking the rotational position of rotor 220 relative to stator 218. In FIGS. 10C and 10D, which are the same cross-sectional views of FIGS. 7 and 10A respectively, the reference numbers have been removed for clarity, and arrows R have been included to represent oil that is being recirculated for rotating rotor 220 relative to stator 218. It should be noted that FIG. 10C shows recirculation check valve 278 being opened, but recirculation check valves 278 may also be closed depending on the direction of the torque reversal of camshaft 214 at a particular time.

It is important to note that oil exclusively flows from supply chambers 298 to whichever of advance chambers 242 and retard chambers 244 need to increase in volume in order to achieve the desired phase relationship of rotor 220 relative to stator 218 while oil exclusively flows to vent chambers 300 from whichever of advance chambers 242 and retard chambers 244 need to decrease in volume in order to achieve the desired phase relationship of rotor 220 relative to stator 218. In this way, only one set of recirculation check valves 278 are needed, acting in one direction within valve spool 228 in order to achieve the desired phase relationship of rotor 220 relative to stator 218. Consequently, it is not necessary to switch between sets of check valves operating in opposite flow directions or switch between an advancing circuit and a retarding circuit. In the case of the position control valve described herein, a unidirectional flow circuit is defined within valve spool 228 when valve spool 228 is moved to a position within rotor 220 to allow either flow from advance chambers 242 to retard chambers 244 or from retard chambers 244 to advance chambers 242 where the flow circuit prevents flow in the opposite directions. Consequently, the flow circuit is defined by valve spool 228 which is simple in construction and low cost to produce.

In operation, the actual rotational position of rotor 220 relative to stator 218 may drift over time from the desired rotational position of rotor 220 relative to stator 218, for example only, due to leakage from advance chambers 242 and/or retard chambers 244. Leakage from advance chambers 242 and/or retard chambers 244 may be the result of, by way of non-limiting example only, manufacturing tolerances or wear of the various components of camshaft phaser 212. An important benefit of valve spool 228 is that valve spool 228 allows for self-correction of the rotational position of rotor 220 relative to stator 218 if the rotational position of rotor 220 relative to stator 218 drifts from the desired rotational position of rotor 220 relative to stator 218. Since the rotational position of valve spool 228 relative to stator 218 is locked by actuator 318, rotor advance passages 274 and rotor retard passages 276 will be moved out of alignment with valve spool lands 296 when rotor 220 drifts relative to stator 218. Consequently, oil will flow to advance chambers 242 from retard chambers 244 and oil will flow from advance chambers 242 to retard chambers 244 as necessary to rotate rotor 220 relative to stator 218 to correct for the drift until each valve spool land 296 is again aligned with respective rotor advance passages 274 and rotor retard passages 276.

It should be noted that oil that may leak from camshaft phaser 212 is replenished from oil provided by oil source 304. Replenishing oil is accomplished by oil source 304 supplying oil to recirculation chamber 294 via bolt supply passage 308, rotor supply passage 306, oil make-up groove 292, and valve spool recirculation passages 302. From recirculation chamber 294, the oil may be supplied to advance chambers 142 or retard chambers 144 as necessary by one or more of the processes described previously for advancing, retarding, or correcting for drift. It should be noted that a portion of bolt supply passage 308 which is downstream of oil make-up check valve 310 is not visible in the figures, but may extend generally radially outward through camshaft phaser attachment bolt 226 to rotor supply passage 306.

While clockwise rotation of rotor 220 relative to stator 218 respectively has been described as advancing camshaft 214 and counterclockwise rotation of rotor 220 relative to stator 218 has been described as retarding camshaft 214, it should now be understood that this relationship may be reversed depending on whether camshaft phaser 212 is mounted to the front of internal combustion engine 210 (shown in the figures) or to the rear of internal combustion engine 210.

The arrangement of recirculation check valves 78 and recirculation check valves 278 as well as recirculation chamber 68 and recirculation chamber 294 as described herein provide for economical manufacture and compactness of camshaft phaser 12 and camshaft phaser 212 respectively.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

an input member connectable to said crankshaft of said internal combustion engine to provide a fixed ratio of rotation between said input member and said crankshaft;

an output member connectable to said camshaft of said internal combustion engine and defining an advance chamber and a retard chamber with said input member;

a valve spool coaxially disposed within said output member such that said valve spool is rotatable about an axis relative to said output member and said input member, said valve spool defining a supply chamber and a vent chamber with said output member;

an actuator which rotates said valve spool in order to change the position of said output member relative to said input member by 1) supplying oil from said supply chamber to said advance chamber and venting oil from said retard chamber to said vent chamber when retarding the phase relationship of said camshaft relative to said crankshaft is desired and 2) supplying oil from said supply chamber to said retard chamber and venting oil from said advance chamber to said vent chamber when advancing the phase relationship between said camshaft relative to said crankshaft is desired; and a recirculation check valve which is displaceable axially between 1) an open position which allows oil to flow from said vent chamber to said supply chamber and 2) a closed position which prevents oil from flowing from said supply chamber to said vent chamber.

2. A camshaft phaser as in claim 1 wherein said recirculation check valve opens into said supply chamber.

3. A camshaft phaser as in claim 1 wherein:

said input member is a stator having a plurality of lobes;

said output member is a rotor coaxially disposed within said stator, said rotor having a plurality of vanes interspersed with said plurality of lobes;

said advance chamber is one of a plurality of advance chambers defined by said plurality of vanes and said plurality of lobes; and said retard chamber is one of a plurality of retard chambers defined by said plurality of vanes and said plurality of lobes.

4. A camshaft phaser as in claim 3 wherein said supply chamber is one of a plurality of supply chambers defined by said valve spool with said rotor and said vent chamber is one of a plurality of vent chambers defined by said valve spool with said rotor such that said plurality of supply chambers are arranged in an alternating pattern with said plurality of vent chambers.

5. A camshaft phaser as in claim 4 wherein said plurality of supply chambers and said plurality of vent chambers are arranged in a polar array.

6. A camshaft phaser as in claim 4 wherein said rotor includes a rotor central hub from which said plurality of vanes extend radially outward therefrom, said rotor central hub having a rotor central through bore extending axially therethrough.

7. A camshaft phaser as in claim 6 wherein:

said rotor central hub defines an annular valve spool recess coaxially therein such that said annular valve spool recess divides said rotor central hub into a rotor central hub inner portion and a rotor central hub outer portion; and said valve spool is rotatably located coaxially within said annular valve spool recess.

8. A camshaft phaser as in claim 7 wherein:

said valve spool includes a spool central hub with a spool central through bore extending coaxially therethrough; and said spool central through bore is sized to mate with said rotor central hub inner portion in a close sliding interface such that said valve spool is able to freely rotate on said rotor central hub inner portion while substantially preventing oil from passing between the close sliding interface of said spool central through bore and said rotor central hub inner portion.

9. A camshaft phaser as in claim 8 wherein a plurality of valve spool lands are circumferentially spaced and extend radially outward from said spool central hub such that said plurality of supply chambers and said plurality of vent chambers are separated by said plurality of valve spool lands.

10. A camshaft phaser as in claim 9 wherein:

an annular spool base extends radially outward from said spool central hub;

an annular spool top extends radially outward from said spool central hub such that said annular spool top is axially spaced from said annular spool base; and said plurality of valve spool lands join said annular spool base to said annular spool top, thereby defining said plurality of supply chambers and said plurality of vent chambers axially between said annular spool base and said annular spool top.

11. A camshaft phaser as in claim 10 wherein said annular spool top includes a plurality of vent passages such that each one of said plurality of vent passages provides a path for oil to exit a respective one of said plurality of vent chambers.

12. A camshaft phaser as in claim 11 wherein said camshaft phaser further comprises:

a back cover closing one axial end of said stator;

a front cover closing the other axial end of said stator such that said plurality of advance chambers and said plurality of retard chambers are defined axially between said back cover and said front cover;

wherein said annular spool base and said annular spool top are captured axially between said annular valve spool recess and said front cover.

13. A camshaft phaser as in claim 12 wherein a recirculation chamber is defined axially between said front cover and said annular spool top.

14. A camshaft phaser as in claim 13 wherein said annular spool top includes a plurality of spool supply passages such that each one of said plurality of spool supply passages provides a path for oil to enter a respective one of said plurality of supply chambers from said recirculation chamber.

15. A camshaft phaser as in claim 14 wherein said recirculation check valve is one of a plurality of recirculation check valves such that each one of said plurality of recirculation check valves allows oil to enter a respective one of said plurality of supply chambers from said recirculation chamber and prevents oil from entering said recirculation chamber from a respective one of said plurality of supply chambers.

16. A camshaft phaser as in claim 15 wherein each one of said plurality of recirculation check valves opens into a respective one of said plurality of supply chambers.

17. A camshaft phaser as in claim 15 wherein each one of said plurality of recirculation check valves comprises a recirculation check valve body which extends through a respective one of said plurality of spool supply passages.

18. A camshaft phaser as in claim 17 wherein a recirculation check valve plate is provided which biases said recirculation check valve body of each of said plurality of recirculation check valves toward said closed position.

19. A camshaft phaser as in claim 18 wherein:

said recirculation check valve body of each of said plurality of recirculation check valves includes a retention orifice extending therethrough in a direction substantially perpendicular to said axis; and said recirculation check valve plate includes a plurality of resilient and compliant recirculation check valve arms such that each one of said plurality of resilient and compliant recirculation check valve arms extends through said retention orifice of said recirculation check valve body of a respective one of said plurality of recirculation check valves.

20. A camshaft phaser as in claim 19 wherein said recirculation check valve plate is annular in shape and disposed between said front cover and said annular spool top.

21. A camshaft phaser as in claim 19 wherein said annular spool top includes a valve spool top recess facing toward said front cover which accommodates said plurality of resilient and compliant recirculation check valve arms when said plurality of recirculation check valves are in said open position.

22. A camshaft phaser as in claim 14 wherein:

an oil make-up chamber is defined axially between said annular spool base and said annular valve spool recess; and said annular spool base includes a plurality of oil make-up passages such that each of said plurality of oil make-up passages provides fluid communication between said oil make-up chamber and a respective one of said plurality of vent chambers, thereby maintaining a common pressure in said oil make-up chamber and said recirculation chamber.

23. A camshaft phaser as in claim 22 wherein said oil make-up chamber is connectable to an oil source.

24. A camshaft phaser as in claim 9 wherein:

said valve spool includes a valve spool inner portion and a valve spool outer portion rotationally fixed to said valve spool inner portion; and a recirculation chamber is defined axially between said valve spool inner portion and said valve spool outer portion.

25. A camshaft phaser as in claim 24 wherein said recirculation check valve is one of a plurality of recirculation check valves such that each one of said plurality of recirculation check valves allows oil to enter said recirculation chamber from a respective one of said plurality of vent chambers and prevents oil from entering a respective one of said plurality of vent chambers from said recirculation chamber.

26. A camshaft phaser as in claim 25 wherein each one of said plurality of recirculation check valves opens into said recirculation chamber.

27. A camshaft phaser as in claim 25 wherein a recirculation check valve plate is provided which biases each of said plurality of recirculation check valves toward said closed position.

28. A camshaft phaser as in claim 27 wherein said recirculation check valve plate includes a plurality of resilient and compliant recirculation check valve arms such that each one of said plurality of recirculation check valves is attached to a respective one of said plurality of resilient and compliant recirculation check valve arms.

29. A camshaft phaser as in claim 28 wherein said recirculation check valve plate is annular in shape and disposed within said recirculation chamber.

30. A camshaft phaser as in claim 28 wherein said recirculation check valve plate, said plurality of resilient and compliant recirculation check valve arms, and said plurality of recirculation check valves are integrally formed as a single piece.

31. A camshaft phaser as in claim 24 wherein opposing axial faces of said valve spool inner portion and said valve spool outer portion are vented, thereby preventing an unbalanced axial force from being applied to said valve spool.

32. A camshaft phaser as in claim 24 wherein an oil make-up groove extends radially outward from said spool central through bore and is fluid communication with said plurality of vent chambers, said oil make-up groove being connectable to an oil source.

* * * * *